US012745850B2

(12) United States Patent
Solmundson et al.

(10) Patent No.: US 12,745,850 B2
(45) Date of Patent: Sep. 29, 2026

(54) WALL BED SYSTEM AND METHOD OF ASSEMBLY

(71) Applicant: Embed Home Products Inc., Winnipeg (CA)

(72) Inventors: Michael Einar Solmundson, Winnipeg (CA); Robert Kenneth Enns, Winnipeg (CA)

(73) Assignee: Embed Home Products Inc., Winnipeg (CA)

( * ) Notice: Subject to any disclaimer, the term of this patent is extended or adjusted under 35 U.S.C. 154(b) by 174 days.

(21) Appl. No.: 18/365,565

(22) Filed: Aug. 4, 2023

(65) Prior Publication Data

US 2024/0050297 A1 Feb. 15, 2024

Related U.S. Application Data

(60) Provisional application No. 63/395,372, filed on Aug. 5, 2022.

(51) Int. Cl.
*A47C 17/46* (2006.01)
*A47C 17/40* (2006.01)

(52) U.S. Cl.
CPC ..... *A47C 17/46* (2013.01); *A47C 17/40* (2013.01)

(58) Field of Classification Search
None
See application file for complete search history.

(56) References Cited

U.S. PATENT DOCUMENTS

2016/0324326 A1* 11/2016 McCoy ..... A47C 17/52

FOREIGN PATENT DOCUMENTS

GB 2537396 A * 10/2016 ..... A47C 19/022

* cited by examiner

*Primary Examiner* — Adam C Ortiz
(74) *Attorney, Agent, or Firm* — Ryan W. Dupuis; Kyle R. Satterthwaite; Ade & Company Inc.

(57) ABSTRACT

A wall bed system has a wall frame secured to a wall and a door frame supporting a mattress to pivot on the wall frame between an enclosed vertical storage position and a horizontal working position for sleeping. The wall frame has a header frame member fastened to the wall, two side frames mounted on opposing ends of the header frame member, and a top frame mounted between the tops of the side frames. One or more of the top frame, the side frames, and the door frame is a modular frame formed of metal frame members surrounding one or more frame openings and one or more finishing panels of finishing material releasably mounted within the one or more frame openings. Perimeter edges of the finishing panels are concealed by the metal frame members to enable a finished appearance even when the panels are cut from various sheet materials.

17 Claims, 17 Drawing Sheets

WALL BED SYSTEM AND METHOD OF ASSEMBLY

This application claims the benefit under 35 U.S.C. 119(e) of U.S. provisional application Ser. No. 63/395,372, filed Aug. 5, 2022.

FIELD OF THE INVENTION

The present invention relates to a wall bed system and method of assembly of the wall bed system in which a pivoting frame assembly supports a mattress thereon while being pivotally coupled to a wall-mounted frame for movement between a storage position in which the mattress is stored in an upright orientation and a working position in which the mattress is horizontal for sleeping.

BACKGROUND

A wall bed is a known arrangement in which a mattress is supported on a door frame that pivots between an upright storage orientation alongside a wall and a horizontal sleeping position for supporting persons thereon for sleeping. A typical wall bed includes an upright wall-mounted frame that functions to conceal the mattress therein in the storage position, but the wall-mounted frame is large and cumbersome to move and install. The door frame that supports the mattress thereon is similarly large and cumbersome so as to be difficult to install on the wall-mounted frame by a single operator.

WO 2015/030672 by Goldwax et all, discloses a Wall Bed Assembly and Kit of Parts for Assembly Into a Wall Bed, in which the wall-mounted frame and the door frame that supports the mattress are each formed in modular sections; however, at least the door frame sections remain large and awkward to position by a single operator.

SUMMARY OF THE INVENTION

According to one aspect of the invention there is provided a wall bed system for mounting against an upright wall of a building, the system comprising:

a wall frame assembly arranged to be secured to the upright wall; and a door frame assembly arranged to support a mattress thereon, the door frame assembly being arranged to be pivotally coupled to the wall frame assembly for movement between a storage position in which the door frame assembly supports the mattress to be fully enclosed in an upright orientation within the wall frame assembly and a working position in which the door frame assembly supports the mattress in a horizontal orientation for sleeping;

the wall frame assembly comprising: (i) a header frame member arranged to be fastened horizontally onto the upright wall, (ii) two side frames arranged to be mounted onto opposing ends of the header frame member respectively at opposing sides of the wall frame assembly, in which the side frames substantially span a depth of the wall frame assembly protruding from the upright wall and substantially span a height of the wall frame assembly, and (iii) a top frame arranged to be mounted between the two side frames at a top of the wall frame assembly, in which the top frame substantially spans a width of the wall frame assembly between the side frames;

the door frame assembly comprising a perimeter frame spanning a width and a length of the door frame assembly;

at least one of the top frame of the wall frame assembly, the side frames of the wall frame assembly, and the perimeter frame of the door frame assembly comprising a modular frame;

the modular frame comprising a plurality of rigid frame members surrounding one or more frame openings of the modular frame and a finishing panel of finishing material arranged to be received within the one or more frame openings so as to be releasably mounted relative to the modular frame.

Preferably the perimeter edges of the finishing panel are concealed by the modular frame in a mounted position of the finishing panel on the modular frame such that the edges of the finishing panels do not require any finishing.

Preferably the finishing panel of the modular frame is readily removable while the modular frame remains in an assembled configuration relative to the wall frame assembly and the door frame assembly.

Preferably the finishing panel of the modular frame is readily removable while the modular frame remains in an assembled configuration relative to the wall frame assembly and the door frame assembly.

The side frames of the wall assembly may each comprise said modular frame, in which each side frame further includes an upper channel defining an upper slot receiving a top edge of the finishing panel and a lower channel defining a lower slot receiving a lower edge of the finishing panel in a mounted position of the finishing panel, wherein a height of the finishing panel is less than a vertical distance between an upper terminal end of the upper slot and an upper edge defining a mouth of the lower slot to enable the finishing panel to be separated from the side frame by lifting until a bottom end of the finishing panel clears the lower slot.

The system may further include (a) a hinge assembly on each side of the wall frame assembly arranged to pivotally couple the wall frame assembly to a corresponding side of the wall frame assembly, the hinge assembly including a biasing arrangement arranged to apply a biasing force acting to assist in closing the door frame assembly towards the storage position; (b) the side frames of the wall frame assembly each comprising said modular frame having (i) said plurality of rigid frame members surrounding the frame opening of the side frame and (ii) said finishing panel arranged to be received within the frame opening; and (c) the frame opening of each side frame spanning a majority of a height of the side frame at a location above the corresponding hinge assembly whereby adjustment of the hinge assembly is accessible through the corresponding frame opening in a closed position of the door frame assembly when the finishing panel is removed from the side frame.

Each side frame may comprises: (i) a hinge assembly arranged to pivotally couple one side of the wall frame assembly to a corresponding side of the door frame assembly, the hinge assembly including a biasing arrangement arranged to apply a biasing force acting to assist in closing the door frame assembly towards the storage position; (ii) a plurality of rigid frame members extending about a perimeter of the side frame; and (iii) a rigid sheet metal panel arranged to span a lower portion of the side frame in alignment with the hinge assembly; wherein the rigid sheet metal panel is supported at an exterior side of the side frame so as to define a cavity between the rigid frame members about the perimeter of the side frame, wherein the cavity is open to an interior of the wall frame assembly, and wherein the cavity receives a portion of the hinge assembly recessed therein in a lateral direction of the wall frame assembly.

The system may be further arranged such that (a) the top frame of the wall frame assembly comprises said modular frame having (i) said plurality of rigid frame members surrounding the frame opening of the top frame and (ii) said finishing panel arranged to be received within the frame opening; and (b) the top frame further comprises a plurality of support flanges mounted on the rigid frame members to protrude into the frame opening so as to be arranged to support said finishing panel thereon at an elevational below a top of the rigid frame members such that the finishing panel is recessed below the top of the rigid frame members.

The system may further include wall fasteners apertures located in one of the rigid frame members of the top frame at a rear of the wall frame assembly arranged to receive fasteners for fastening the wall frame assembly to the upright wall of the building, the wall fastener apertures being concealed by said finishing panel in a mounted position of the finishing panel on the top frame.

The system may further include frame fastener apertures in the rigid frame members arranged to receive fasteners for fasting the top frame to each side frame of the wall frame assembly, in which the frame fastener apertures are concealed by said finishing panel in a mounted position of the finishing panel on the top frame.

The header frame member of the wall bed system preferably comprises: (i) an elongate rigid member having a rear surface arranged for abutment against said upright wall; (ii) wall fastener apertures at laterally spaced apart positions along the rigid member so as to be arranged to receive fasteners to fasten the header frame member against said upright wall; (iii) frame mounts at opposing ends of the header frame member arranged for fixed mounting to the two side frames respectively; and (iv) the frame mounts being spaced forwardly of said rear surface whereby the frame mounts are arranged for connection to the side frames subsequent to mounting of the header frame member onto the upright wall of the building.

Each frame mount may comprise (i) a mounting flange oriented parallel to the rear surface at a location spaced forwardly of the rear surface and (ii) at least one frame fastener aperture in the mounting flange arranged to receive a fastener to fasten the mounting flange to the respective side frame.

The system may further include a headboard mounting member comprising: (i) a first flange having a forward surface arranged for abutment against a rear side of a headboard and fasteners apertures so as to be arranged for fastening the first flange to the rear side of the headboard, and (ii) a second flange extending downwardly and rearwardly from the first flange to a free edge of the second flange in a mounted position of the headboard such that the second flange defines a hook arranged to be received between the support flange of the header frame member and said upright wall in the mounted position of the headboard.

Each side frame is preferably arranged to be fastened to the top frame and the header frame member at a location spaced laterally inward from an exterior side surface of the side frame farthest from the other side frame.

Each side frame is preferably arranged to be fastened to the top frame and the header frame member using fasteners oriented parallel to a plane of the exterior side surface of the side frame.

The perimeter frame of the door frame assembly of the wall bed system may further includes (i) at least one frame opening surrounded by rigid frame members of the perimeter frame and (ii) a finishing panel supported within said at least one frame opening by support flanges mounted on the rigid frame members and extending about a full perimeter of said at least one frame opening.

When the door frame assembly includes a plurality of frame openings, the rigid frame members of the perimeter frame of the door frame assembly may further comprise: (i) two side rails spanning a length of the door frame assembly at laterally opposing sides of the door frame assembly respectively, each side rail including an inner flange protruding inwardly towards the other side rail defining the support flanges that support laterally opposing sides of each finishing panel thereon; (ii) a head frame member connected between the two side rails at a head end of the door frame assembly; (iii) a foot frame member connected between the two side rails at a foot end of the door frame assembly; and (iv) an intermediate support mounted between each adjacent pair of the finishing panels, the intermediate support being supported on the inner flanges of the side rails at opposing ends thereof; (v) wherein some of the support flanges are supported on the head frame member, on the foot frame member and on the intermediate support so as to be arranged to support opposing ends of the finishing panels thereon.

The system may be further arranged to include (i) said rigid frame members of the perimeter frame further comprising upper flanges mounted on the rigid frame members along a portion of said at least one frame opening at a location spaced from the support flanges by a thickness of said at least one finishing panel such that corresponding edges of said at least one finishing panel are captured between one of the support flanges and one of the upper flanges about said portion of said at least one frame opening; and (ii) the upper flanges and an inner surface of said at least one finishing panel collectively defining a continuous supporting surface arranged to support the mattress thereon.

According to another aspect of the present invention, there is provided a method of assembling a wall bed against an upright wall of a building, the method comprising:

providing a wall bed system comprising:

(i) a wall frame assembly arranged to be secured to the upright wall; and (ii) a door frame assembly arranged to support a mattress thereon, the door frame assembly being arranged to be pivotally coupled to the wall frame assembly for movement between a storage position in which the door frame assembly supports the mattress to be fully enclosed in an upright orientation within the wall frame assembly and a working position in which the door frame assembly supports the mattress in a horizontal orientation for sleeping;

(iii) the wall frame assembly comprising: (a) a header frame member, (b) two side frames arranged to substantially span a depth of the wall frame assembly protruding from the upright wall and substantially span a height of the wall frame assembly, and (c) a top frame arranged to substantially spans a width of the wall frame assembly between the side frames;

(iv) the door frame assembly comprising a perimeter frame spanning a width and a length of the door frame assembly;

mounting the header frame member on the upright wall;

mounting the side frames on opposing ends of the header frame member subsequent to the header frame member being mounted on the upright wall;

mounting the top frame between the side frames at a top of the wall frame assembly;

mounting the perimeter frame of the door frame assembly on the side frames of the wall frame assembly so as to be pivotal between the working position and the storage position.

When at least one of the top frame or the side frames comprises a modular frame comprised of rigid frame members surrounding at least one frame openings in the modular frame, the method may further include mounting a finishing panel within said at least one finishing panel subsequent to the modular frame being mounted in fixed relation to the upright wall of the building.

The method may further comprise the following steps of assembling the door frame assembly in which the door frame assembly comprises plurality of rigid frame members surrounding a plurality of frame openings in the perimeter frame and a finishing panel mounted within each frame opening in which the rigid frame members of the door frame assembly comprise (i) two side rails for spanning a length of the door frame assembly at laterally opposing sides of the door frame assembly respectively, (ii) a head frame member for connection between the two side rails at a head end of the door frame assembly, (iii) a foot frame member for connection between the two side rails at a foot end of the door frame assembly, and (iv) an intermediate support for mounting between each adjacent pair of the finishing panels. The method preferably includes (i) pivotally coupling the side rails of the door frame assembly onto the side frames of the wall frame assembly and mounting the head frame member between the two side rails at the head end of the door frame assembly; (ii) mounting a first panel among the finishing panels between the side rails at the head end of the door frame assembly; (iii) mounting the intermediate support against an inner end of the first panel subsequent to the first panel being mounted between the side rails and prior to a second panel among the finishing panels being installed between the side rails; and (iv) subsequent to all finishing panels being mounted between the side rails, mounting the foot frame member between the side rails at the foot end of the door frame assembly.

BRIEF DESCRIPTION OF THE DRAWINGS

Some embodiments of the invention will now be described in conjunction with the accompanying drawings in which.

In the drawings like characters of reference indicate corresponding parts in the different figures.

DETAILED DESCRIPTION

Figure 2:
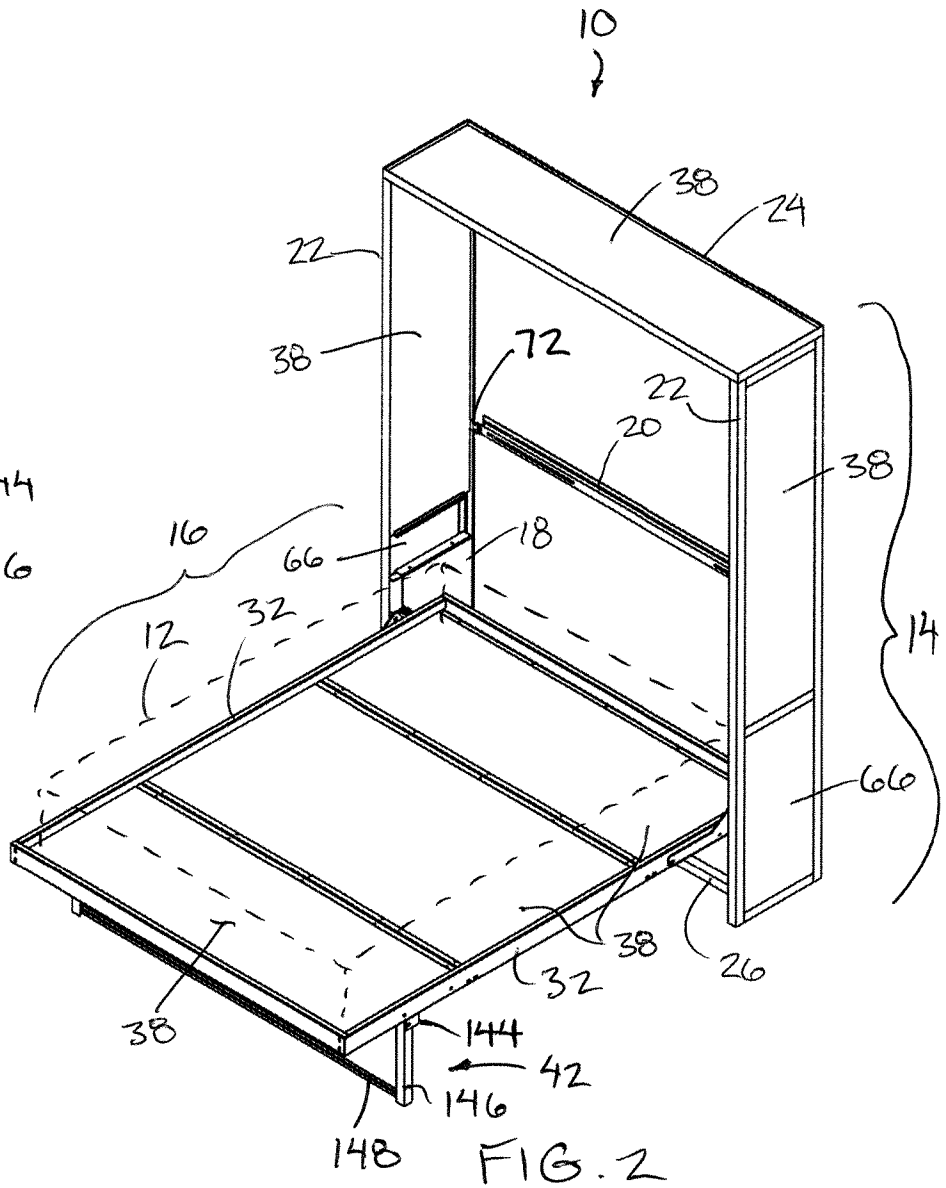
FIG. 2 is a perspective view of the wall bed system according to the first embodiment of FIG. 1 in a working position.
Figure 1:
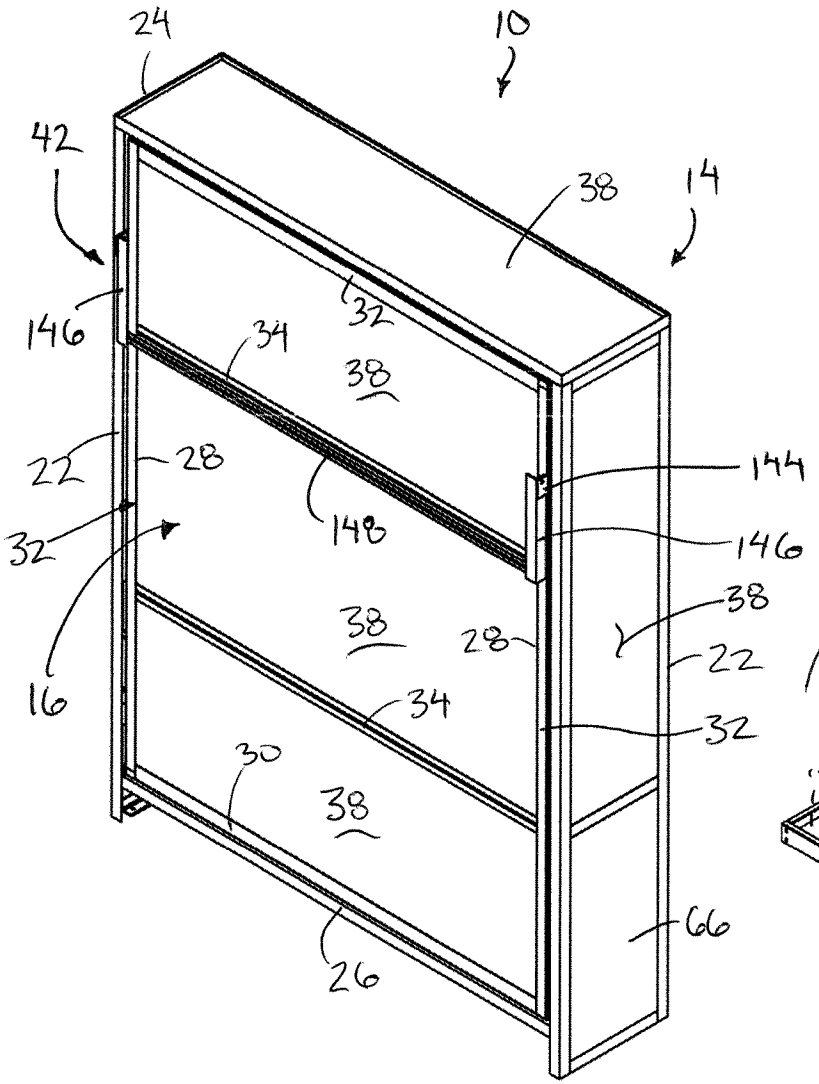
FIG. 1 is a perspective view of the wall bed system in a storage position according to a first embodiment.
Figure 3:
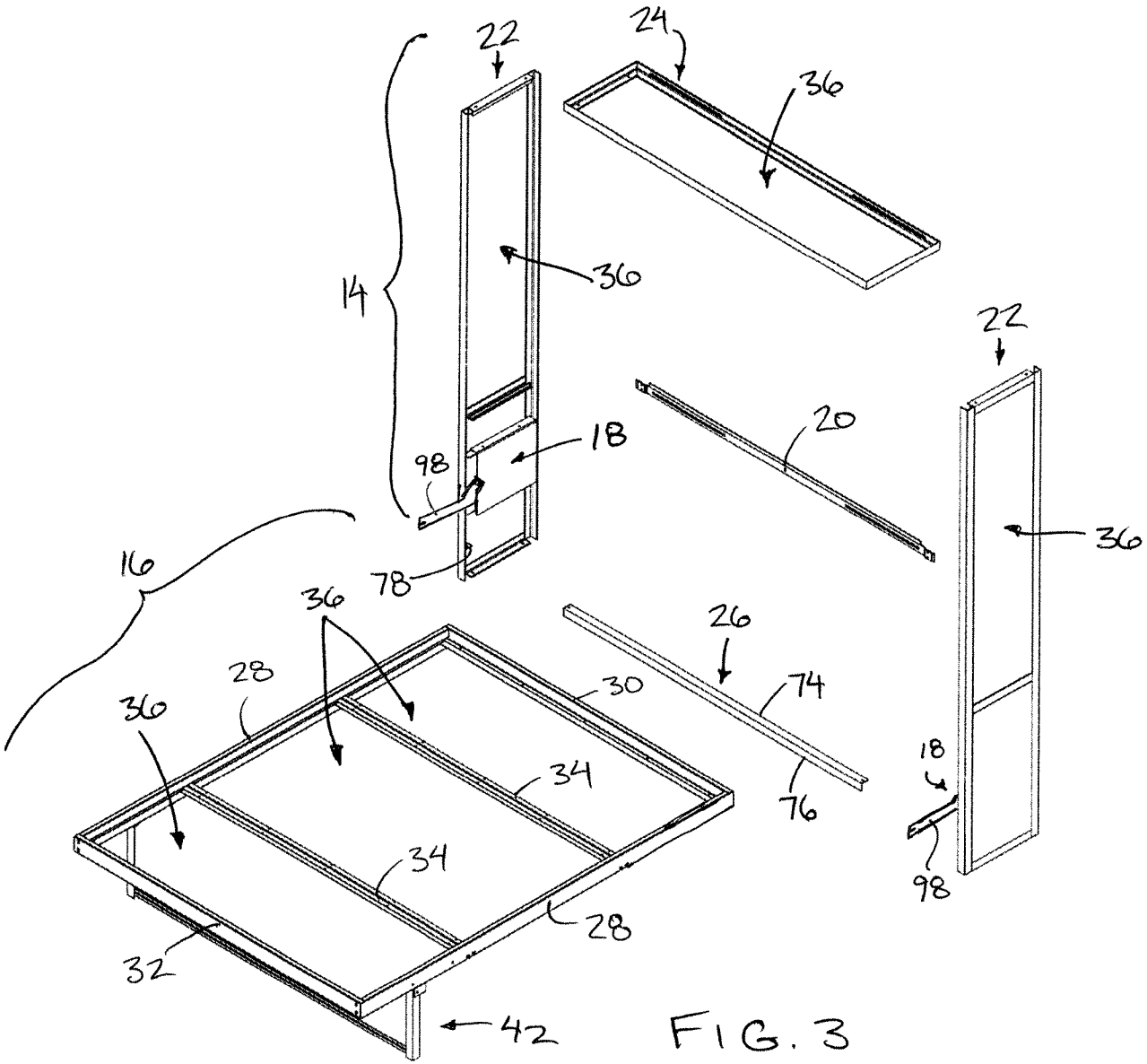
FIG. 3 is an exploded perspective view of the wall bed system according to the first embodiment of FIG. 1.
Figure 5:
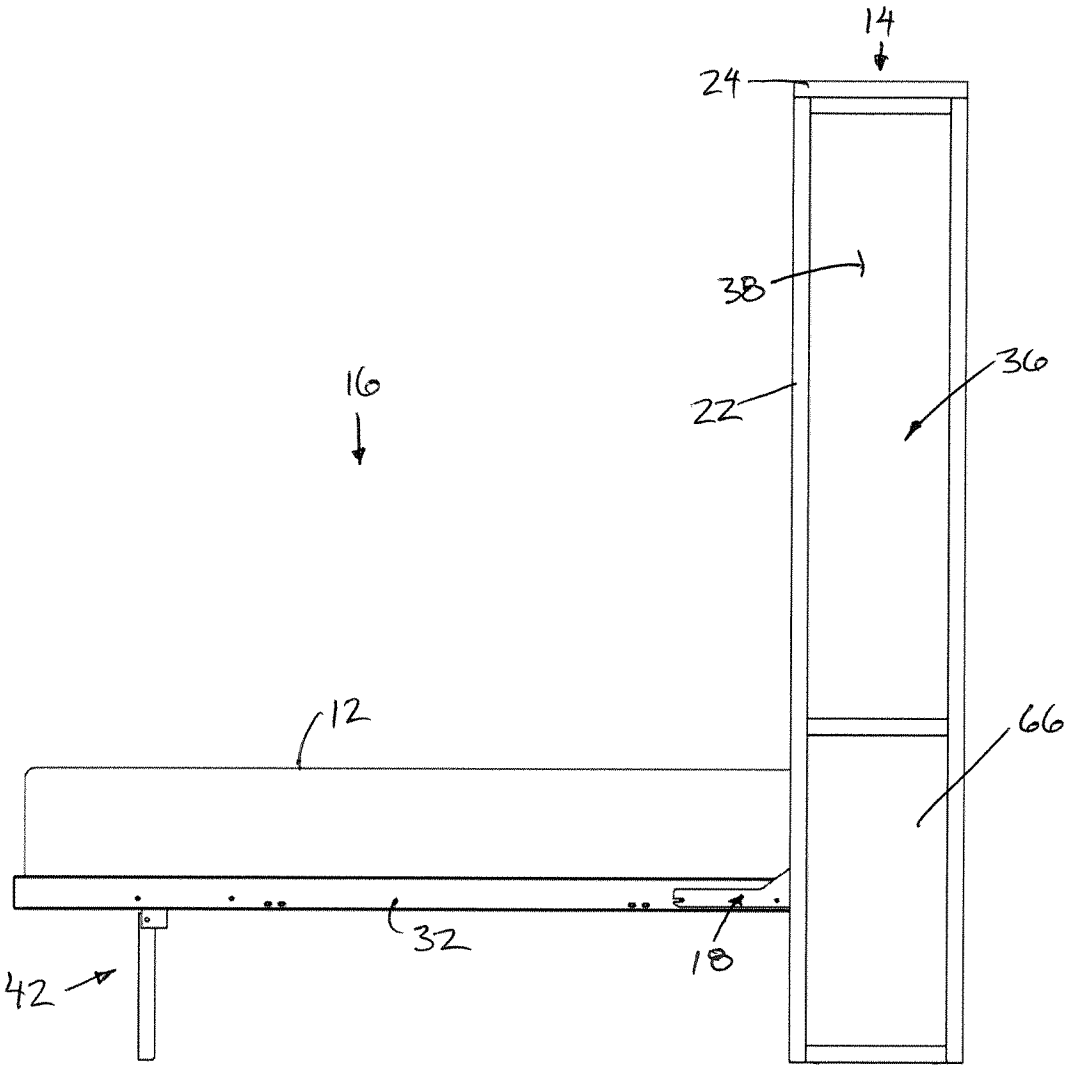
FIG. 5 is a side view of the wall bed system in the working position according to the first embodiment of FIG. 1.
Figure 4:
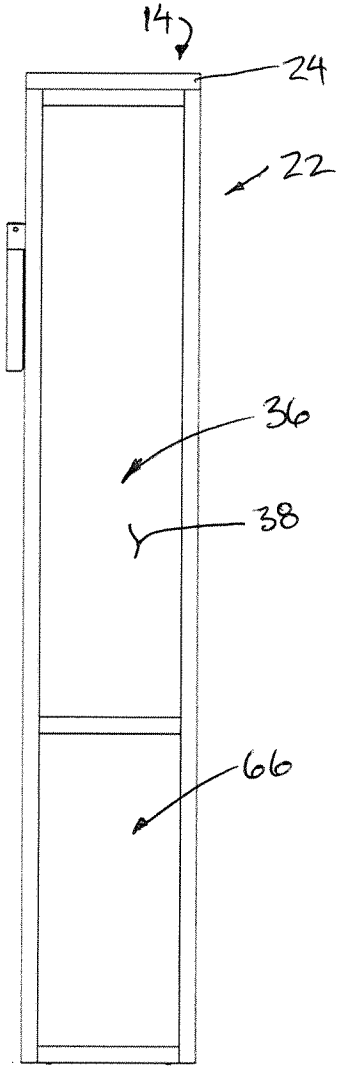
FIG. 4 is a side view of the wall bed system in the storage position according to the first embodiment of FIG. 1.
Figure 6:
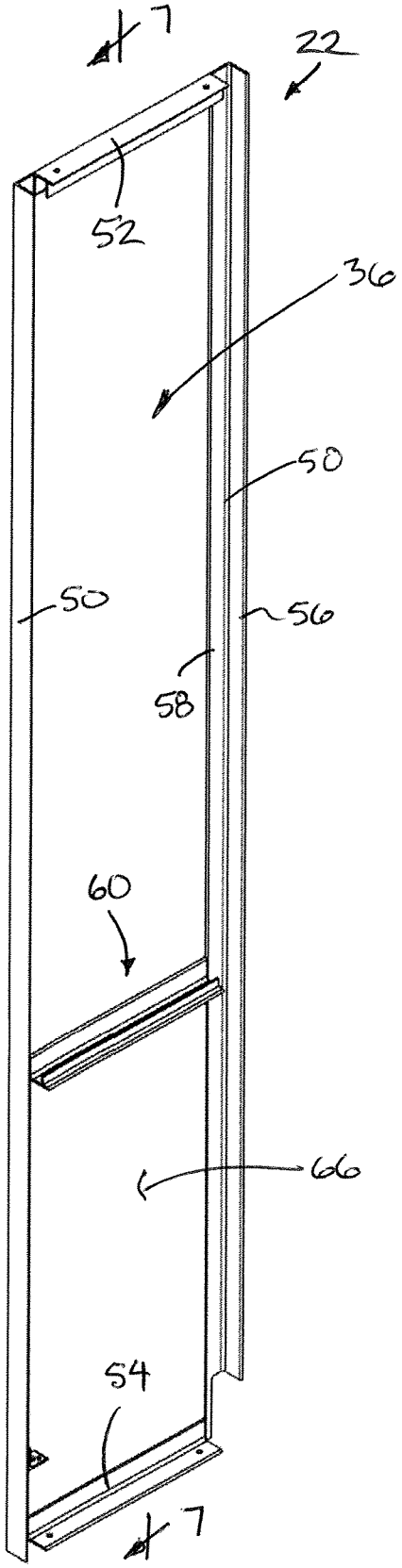
FIG. 6 perspective view of one of the side frames of the wall frame assembly according to the first embodiment of FIG. 1.
Figure 7:
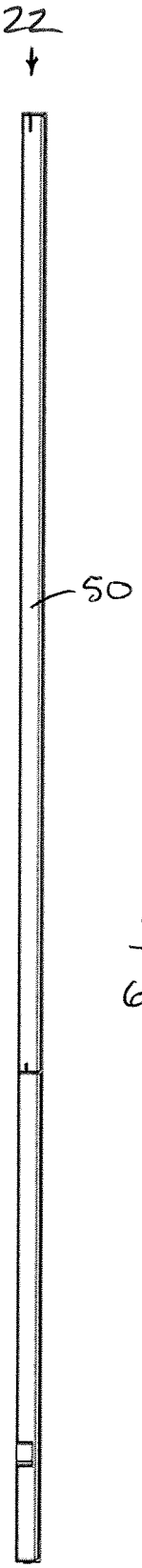
FIG. 7 is a sectional view along the line 7-7 in FIG. 6.
Figure 8:
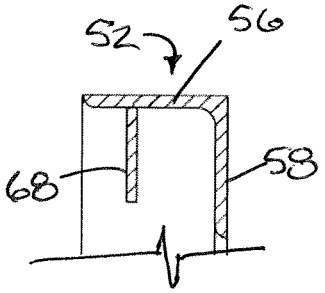
FIG. 8 is an enlarged view of the upper portion of FIG. 7.
Figure 9:
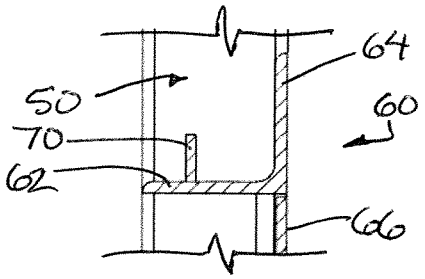
FIG. 9 is an enlarged view of an intermediate portion of FIG. 7.
Figure 10:
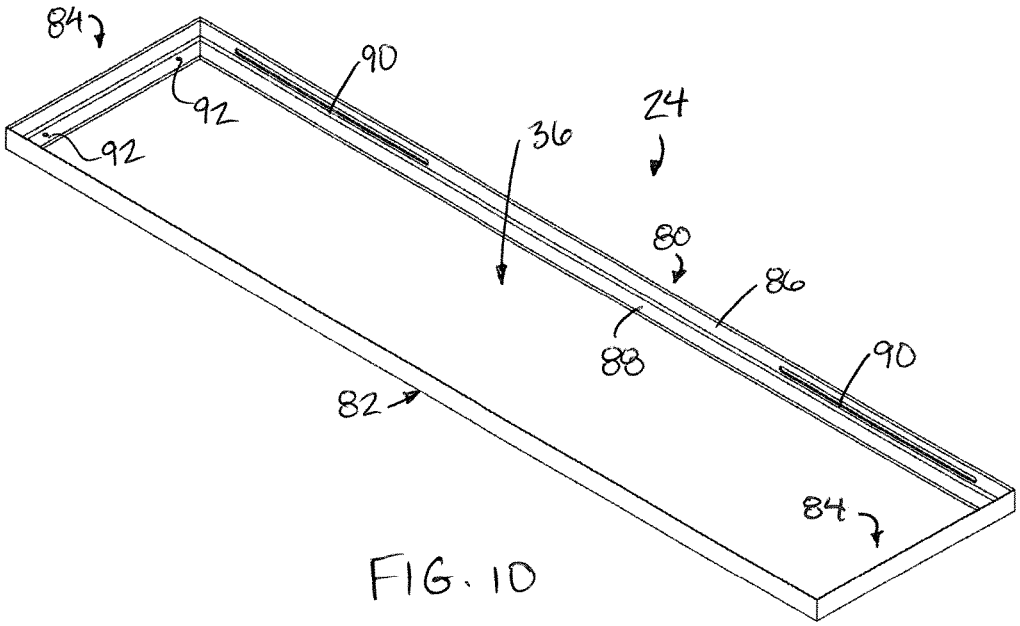
FIG. 10 is a perspective view of the top frame of the wall frame assembly according to the first embodiment of FIG. 1.
Figure 11:
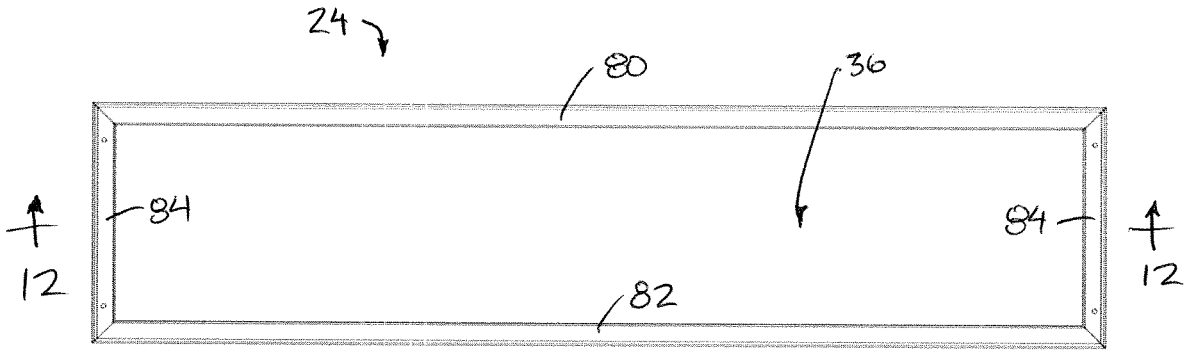
FIG. 11 is a top view of the top frame of FIG. 10.
Figure 12:
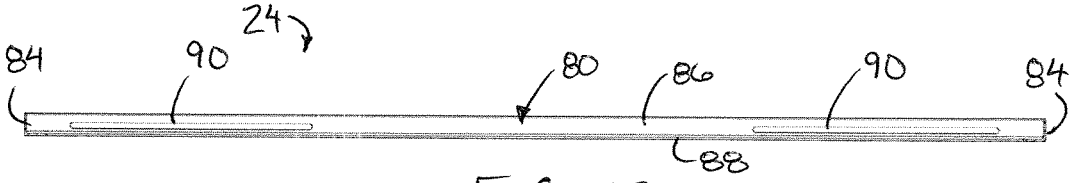
FIG. 12 is a sectional view along the line 12-12 of FIG. 11.
Figure 13:
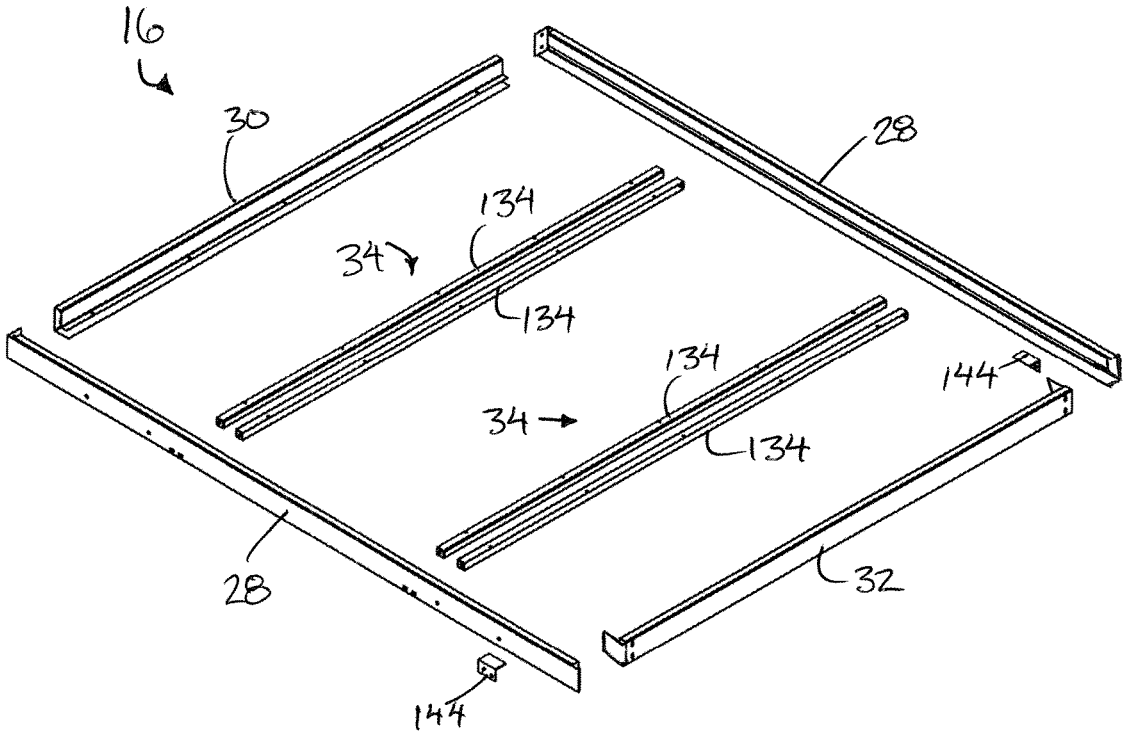
FIG. 13 is an exploded perspective view of the door frame assembly according to the first embodiment of FIG. 1.
Figure 14:
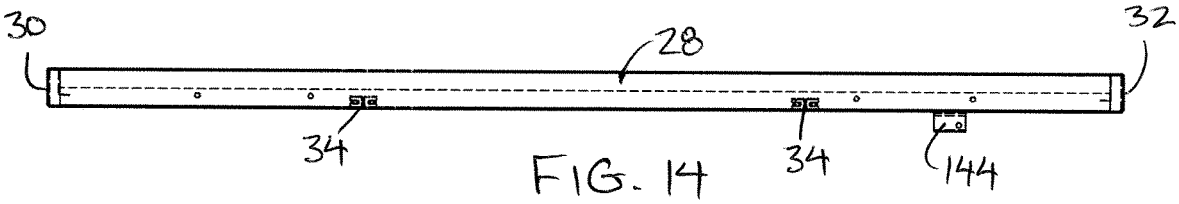
FIG. 14 is a side view of the door frame assembly according to the first embodiment of FIG. 1.
Figure 15:
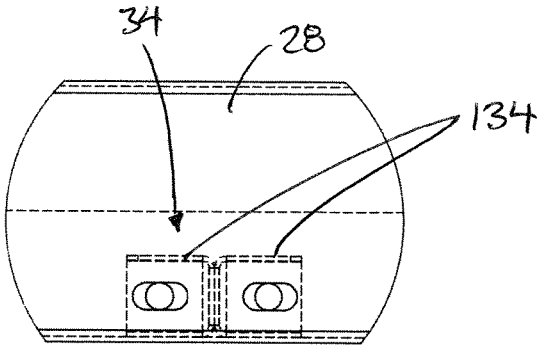
FIG. 15 an enlarged view of an intermediate portion of the door frame assembly of FIG. 14.
Figure 16:
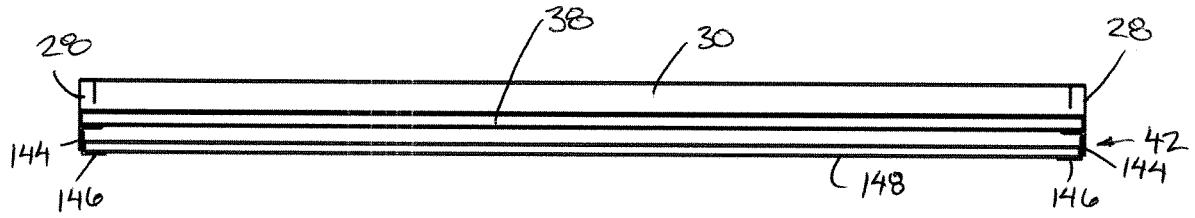
FIG. 16 is a partly sectional end view of the door frame assembly according to the first embodiment of FIG. 1.
Figure 17:
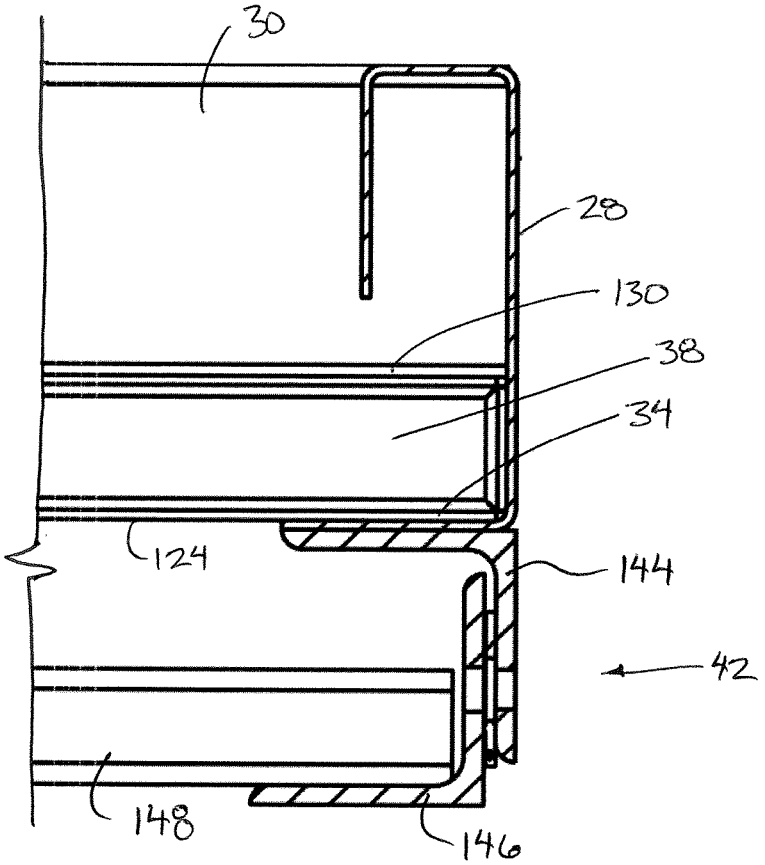
FIG. 17 is an enlarged view of the cross-section of one of the side rails of the door frame assembly according to the first embodiment of FIG. 1.
Figure 18:
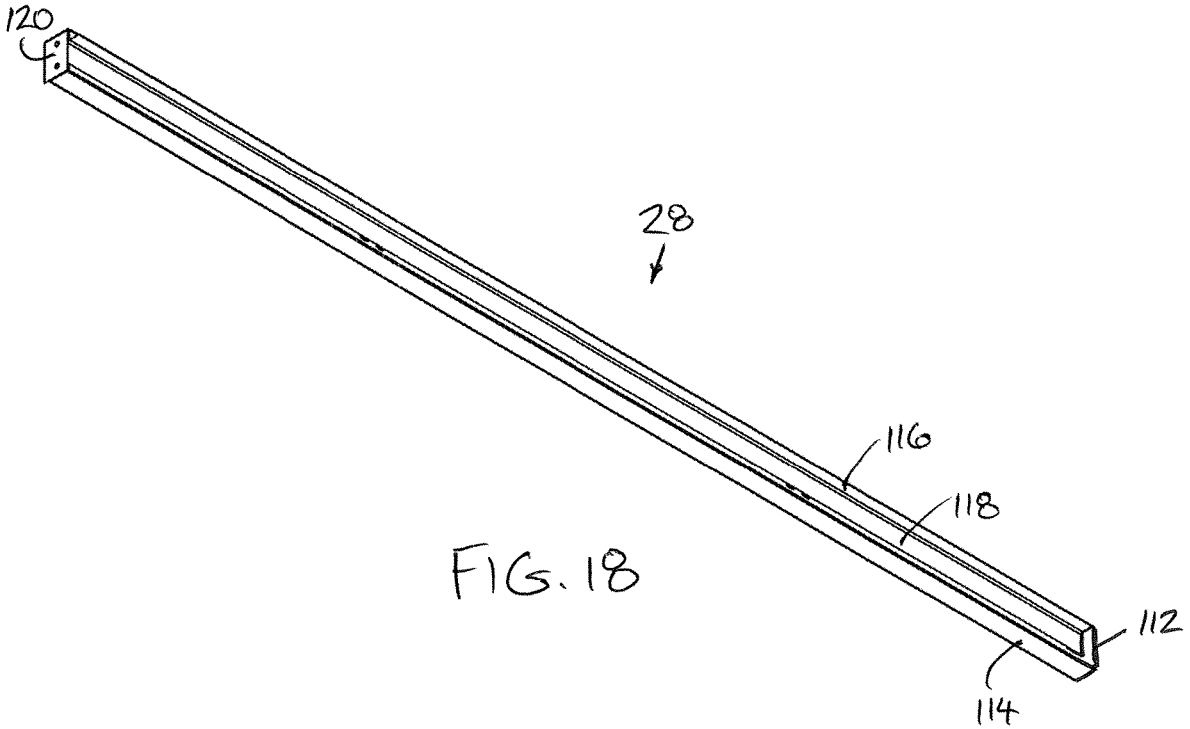
FIG. 18 is a perspective view of one of the side rails of the door frame assembly according to the first embodiment of FIG. 1.
Figure 19:
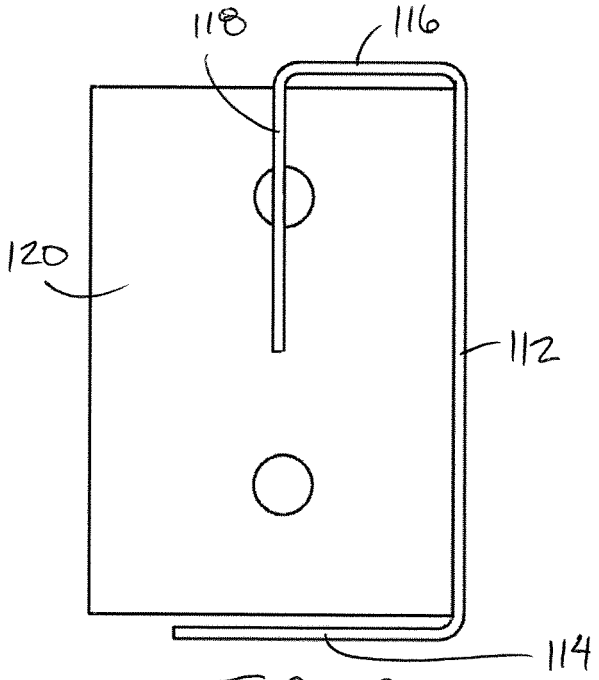
FIG. 19 is an end view of the side rail of FIG. 18.

Referring to the accompanying figures, there is illustrated a wall bed system generally indicated by reference numeral 10. Although various embodiments are shown in the accompanying figures, the common features of the various embodiments will first be described.

The wall bed system 10 is particularly suited for mounting against an upright wall of a building to support a mattress 12 such that the mattress can be displaced between a storage position in which the mattress is in an upright orientation adjacent to the upright wall so as to be fully enclosed within an enclosure formed by the wall bed system and a working position in which the mattress is supported in a horizontal orientation to support a user thereon for sleeping.

The overall wall bed system generally comprises a wall frame assembly 14 arranged to be mounted fixed and immovably relative to the building wall, a door frame assembly 16 arranged to support the mattress 12 thereon for pivoting together with the mattress relative to the wall frame assembly 14 between the storage and working positions, and a hinge assembly 18 pivotally coupling the door frame assembly to the wall frame assembly to support the door frame assembly for pivotal movement between the storage and working positions.

The wall frame assembly 14 is generally delivered to an installation site as a kit of separate frame sections to be assembled onto the wall. These include a header frame member 20 arranged to be mounted to extend horizontally across a portion of the building wall, two side frames 22 spanning the height and depth of the wall frame assembly at laterally opposing sides thereof, a top frame 24 spanning the width and the depth of the wall frame assembly between the top end of the two side frames, and a bottom frame member 26 extending laterally between the two side frames at the front side thereof spaced slightly above the bottom to maintain the side frames at a fixed spacing in parallel orientation to one another.

The door frame assembly 16 comprises a perimeter door frame assembled from two side rails 28 extending the length of the door frame at laterally opposing sides thereof for pivotal connection by the hinge assemblies 18 to the two side frames 22 of the wall frame assembly respectively, a head frame member 30 joined between the two side rails at the head end of the perimeter door frame, a foot frame member 32 joined between the two side rails at the foot end of the perimeter door frame, and two intermediate supports 34 coupled between the two side rails 28 at spaced apart positions in a longitudinal direction of the perimeter door frame to separate the perimeter frame into three distinct frame openings 36 which receive respective finishing panels 38 mounted therein in the assembled configuration of the wall bed system.

Each of the side frames and the top frame of the wall frame assembly are formed of rigid frame members described in further detail below such that each frame also defines a respective frame opening 36 therein similar to the frame openings in the door frame assembly such that each frame opening of the side frames and the top frame also receives a finishing panel 38 mounted therein.

The rigid frame members forming the various frames noted above typically comprise rigid metal members. Alternatively, the finishing panels 38 supported within the frame opening of each frame typically comprises a rigid wood sheet which remains exposed at one or both inner and outer side surfaces such that the panel has a finished appearance, for example a painted surface, a coated surface of a suitable finishing material or a stained wood appearance. The perimeter edges of each finishing panel need not be finished as the frames are arranged in each instance such that the panels are received within the respective frame openings in a manner which conceals the perimeter edges about the full perimeter thereof. The mounting configurations provided for supporting the panels within the frame openings respectively are typically arranged to receive dimensional sheet lumber which has been cut to a suitable size for the opening while maintaining a standard thickness which may be for example ½, ⅝ or ¾ of an inch in thickness.

The wall bed system 10 further includes a headboard mounting member 40 which is suitably arranged for mounting a headboard 41 onto the header frame member 20 as described in further detail below.

In addition, a leg assembly 42 is provided which is supported on the door frame assembly closer to the foot end than the head end thereof in which the leg assembly is pivotal to lie flat against the exterior of the door frame assembly in the storage position but which protrudes downwardly from the horizontal door frame assembly in the working position to provide support for supporting the foot end of the door frame assembly at a prescribed spacing above the floor.

The header frame member 20 is a singular, elongate, rigid, metal bar which extends in a lateral direction between two laterally opposing ends thereof. The frame member has a flat rear surface range for abutment against the upright building wall. A set of elongate slots 44, that are elongated in the lateral direction and that are spaced apart from one another in the lateral direction, define wall fastener apertures in the header frame member which served to receive wall fasteners therethrough in alignment with studs within the building wall for fastening the header frame member securely to the wall.

The header frame member 20 further includes a support flange 46 protruding from a top edge of the flat metal bar forming the main body of the header frame member. The support flange extends substantially the full length of the header frame member in the lateral direction while extending upwardly and forwardly to an upper free edge which is spaced forwardly of a plane of the rear surface of the header frame member. In this manner the upper free edge of the support flange 46 is spaced forwardly of the wall when the rear surface is mounted and fastened flat against the wall.

A set of two frame mounts 48 are mounted at the opposing ends of the header frame member respectively. Each frame mount 48 is a flange lying generally parallel to the rear surface of the header frame member at a location spaced slightly forwardly thereof. The frame mounts further include a set of two frame fastener apertures therein which enable fastening of the header frame member to the two side frames 22 of the wall frame assembly respectively using suitable threaded fasteners.

Turning now to FIGS. 1 through 30, a first embodiment of the wall bed system 10 will now be described in further detail.

The side frames 22 of the wall frame assembly each comprise rigid frame members that define a single frame opening 36 that receives one of the finishing panels 38 therein. More particularly, each side frame is comprised of two side members 50 spanning a full height of the side frame at opposing front and rear sides of the frame, a top member 52 connected between the top ends of the two side members 50 and a bottom member 54 connected between the bottom ends of the two side members. Each of the members 50, 52 and 54 is formed of an angle having a perimeter flange 56 spanning the full thickness of the side frame at the outer perimeter edge of the frame and an inner flange 58 protruding inwardly towards an opposing member of the frame such that all of the inner flanges 58 lie in a common plane at the exterior side of the side frame.

Each side frame 22 also includes an additional intermediate member 60 connected between the side members 50 at an intermediate height just above the corresponding hinge assembly 18. The intermediate member similarly comprises an angle having a first flange 62 spanning the thickness of the side frame parallel to the perimeter flange 56 of the top and bottom members and a second flange 64 lying in a common plane with the inner flanges 58 of the other frame members so that the second flange is flush with the exterior side of the side frame. The frame opening 36 in this instance is bound by the two side members 50, the top member 52 and the intermediate member 60.

A rigid metal sheet 66 spans a remaining bottom portion of the side frame extending between the side members and spanning a height between the bottom member 54 and the intermediate member 60. The metal sheet 66 is a thin sheet which is mounted flush with the inner flanges 58 at the exterior side of the side frame so that a cavity is defined to the interior of the metal sheet 66 occupying the thickness of the side members 50 in the lateral direction of the wall bed system. The cavity remains open to the interior of the wall frame assembly and is aligned with the corresponding hinge assembly so that a majority of the hinge assembly can be recessed into the cavity of the side frame in a lateral direction of the wall bed system.

In order to support a finishing panel within the frame opening of each side frame, each side frame is provided with an upper channel along the top member 52 and a lower channel along the intermediate member 60 which receive opposing top and bottom edges of the finishing panel therein. More particularly, the upper channel is formed by an inner plate 68 mounted on the perimeter flange 56 at a location which is parallel and spaced laterally towards the interior of the wall frame assembly relative to the inner flange 58 so that a resulting upper slot is formed between the inner plate 68 and the inner flange 58 having an upper terminal end of the upper slot defined by the perimeter flange 56 of the top member 52. The inner plate 68 protrudes downwardly by a distance which is less than the inner flange 58 of the top member 52 while being spaced laterally therefrom by a distance corresponding approximately to the thickness of the finishing panel received therein. The bottom edges of the inner plate and the inner flange define opposing edges of a mouth of the upper slot.

Similarly, the lower channel is formed by an inner plate 70 mounted on the first flange 62 of the intermediate member 60 at a location which is parallel to and spaced laterally towards the interior of the wall frame relative to the second flange 64 so that a resulting lower slot is formed between the inner plate 70 and the second flange 64 having a lower terminal end of the lower slot defined by the first flange 62 of the intermediate member. The inner plate 70 protrudes upwardly by a distance which is less than the second flange 64 of the intermediate member while being spaced laterally inward therefrom by distance corresponding approximately to the thickness of the finishing panel received therein. The upper edges of the inner plate 70 and the second flange 64 define opposing edges of a mouth of the upper slot.

The upper channel is arranged to be deeper between the mouth of the slot and the terminal inner end of the slot than the lower channel. Additionally, a height of the finishing panel 38 for each side frame 22 is less than a vertical distance between the upper terminal end of the upper slot defined by the perimeter flange 56 of the top member 52 and an upper edge of the inner plate 70 defining the lowest boundary of the mouth of the lower slot. In this manner the finishing panel can be separated from the side frame by lifting the panel until a bottom end of the finishing panel clears the upper edge of the inner plate so that the bottom edge of the finishing panel can be subsequently swung laterally into the interior of the wall frame assembly for subsequent downward release from the upper slot. The reverse operation of lifting the top edge of the finishing panel into the upper slot followed by alignment of the bottom edge of the finishing panel with the lower slot and dropping of the finishing panel into the lower slot serves to mount the finishing panel within the frame opening of each side frame.

A finishing panel 38 is typically cut from any desirable sheet material so that the sheet fits between the perimeter flanges of the two side members 50 in a direction corresponding to the depth of the wall frame assembly protruding from the wall while having a length corresponding to the vertical distance described above which enables the finishing panel to be pivoted and dropped into place within the upper and lower channels. In a mounted position of the finishing panel within each side frame, the inner flanges 58 and the second flange 64 of the frame members about the frame opening overlap the exterior face of the finishing panel about the full perimeter thereof while the perimeter edges are concealed and abutted against perimeter flanges or the first flange of the frame members about the frame opening so that the perimeter edges of the finishing panel can remain unfinished with their appearance being hidden in the assembled configuration.

Each side frame further includes a mounting tab 72 situated at the rear side of the side frame at a location spaced forward of the rear of the frame to be suited for flat abutment against a corresponding frame mount 48 at a corresponding end of the header frame member 20. Suitable frame fastener apertures are located in the mounting tab 72 for alignment with corresponding apertures in the frame mounts 48 for fastening with suitable threaded fasteners therebetween subsequent to the header frame member 20 already being mounted in place on the wall. In a mounted configuration, the fasteners joining the mounting tabs 72 to the frame mounts 48 are oriented horizontally, perpendicularly to the building wall, and parallel to a plane of the side frame.

The bottom frame member 26 is a single, rigid, metal bar forming an angle in profile having a horizontal flange 74 arranged to be mounted to the side frames 22 at opposing ends thereof and a vertical flange 76 extending downward from a front edge of the horizontal flange 74 along the length thereof. The horizontal flange 74 aligns with the mounting tabs 78 mounted on the forwardmost side member 50 of each side frame rearwardly of the perimeter flange 56 generally within the same cavity that partly receives the hinge assembly therein. Cooperating fastener apertures in the mounting tabs 78 and the horizontal flange 74 of the bottom member 26 allow suitable threaded fasteners to fasten the bottom member between the side frames. The fastener apertures in this instance are oriented so that the resulting fasteners are vertical, parallel to the wall and parallel to a plane of the corresponding side frame.

The top frame 24 includes a rear member 80 extending along a rear side of the top frame, a front member 82 extending along a front side of the top frame, and two side members 84 coupled between the front and rear members at laterally opposing ends of the top frame. Each of the frame members of the top frame includes an upright perimeter flange 86 spanning a thickness of the top frame at the outer perimeter edge and an inner support flange 88 extending horizontally inward towards the opposing frame member from a bottom edge of the corresponding perimeter flange 86. The frame members collectively extend about the full perimeter of the top frame to fully surround a central frame opening 36 that occupies the majority of the area of the top frame. The thickness of the frame members, corresponding to a height of the top frame, is greater than the thickness of the finishing panel received within the frame opening of the top frame so that the support flanges 88 are in turn recessed below the top side of the top frame by a distance which is greater than the panel thickness, thereby enabling the perimeter edges of the finishing panel mounted in the top frame to be concealed by the frame members of the top frame. The finishing panel for the top frame can be cut to span substantially the full depth of the top frame between the perimeter flanges of the front and rear members and the full width in the lateral direction between the perimeter flanges of the two side members 84.

The perimeter flange 86 of the rear member 80 includes a pair of wall fastener apertures 90 formed therein which enable fasteners to be received therethrough for fastening the perimeter flange at the rear of the top frame against the upright wall. Each wall fastener aperture 90 is an elongate slot which is elongated in the lateral direction while the wall fastener apertures 90 are also spaced apart from one another in the lateral direction. This enables wall fasteners to be adjustably positioned in the lateral direction relative to the top frame for alignment with studs within the wall.

The inner support flanges 80 of the two side members 84 also include spaced apart frame fastener apertures 92 formed therein which are arranged for alignment with corresponding fastener apertures within the perimeter flanges 56 of the top members 52 at the top end of the two side frames 22 respectively. In this manner fasteners can be penetrated through the corresponding frame fastener apertures 92 for fastening opposing ends of the top frame 24 onto the top ends of the two side frames 22. The fastener apertures are oriented so that the resulting fasteners extend through the fastener apertures in a vertical orientation that is parallel to the building wall and parallel to a plane of the respective side frame.

The placement of the fastener apertures 90 and 92 in the top frame are such that the fasteners are concealed by mounting of the finishing panel within the frame opening 36 of the top frame.

Turning now to the hinge assembly 18, one hinge assembly 18 is supported on each side frame for pivotally coupling a respective side of the door frame assembly to the wall frame assembly. In each instance the hinge assembly 18 includes a mounting plate 94 secured against the inner side of the rigid metal sheet 66 of the side frame within the cavity in the side frame, for example by welding or fastening. The mounting plate 94 supports a pivot shaft 96 protruding inwardly in the lateral direction of the wall frame assembly from a lower, forward portion of the mounting plate. The pivot shaft 96 is aligned with the corresponding pivot shaft of the other hinge assembly to collectively define the pivot axis of the door frame assembly relative to the wall frame assembly.

A pivot arm 98 is provided in the form of an elongate plate which is mounted by a suitable bearing onto the pivot shaft 96 on the mounting plate. The pivot arm is elongate between a first end pivoted on the pivot shaft 96 and an opposing second end, thereby defining a long axis of the pivot arm. The pivot arm is supported to be pivoted so that the long axis extends generally horizontally and forwardly from the pivot shaft in the working or open position of the door frame assembly, while extending generally vertically and upwardly from the pivot shaft in the storage or closed position of the door frame assembly.

A biasing arrangement of the hinge assembly provides a lifting force to the door frame assembly, acting in a direction to assist closing of the door frame assembly towards the storage position. In this regard, a rear plate 100 is mounted along the rear edge of the mounting plate 94 which provides a vertical row of mounting apertures therein which mount the rear ends of a plurality of biasing springs 102 thereon. An opposing front plate 104 is supported for floating movement relative to the mounting plate 94 at a location forwardly of the rear plate 100. The front plate similarly includes a vertical row of spring mounting apertures for mounting forward ends of the biasing springs 102 thereon. The springs are all mounted to extend generally forwardly from the rear plate to the front plate 104 in parallel relationship with one another.

A connecting arm 106 serves to connect the front plate 104 of the biasing arrangement to the pivot arm 98 of the hinge assembly. The connecting arm includes a pivot mount at the forward end thereof for pivotal connection to the pivot arm 98 at a location which is above and slightly forwardly of the pivot axis in the working position and which is rearward but slightly above the pivot axis in the storage position. The pivot mount location pivots through a range of 90 degrees about the pivot axis together with pivoting movement of the pivot arm between the working position and the storage position to displace the front plate 104 forwardly and stretch the springs under tension as the door frame assembly is pivoted from the storage position to the working position. The tension of the springs is adjusted to provide sufficient biasing force to offset a substantial portion of the weight of the door frame assembly and a mattress supported thereon to assist in lifting the door frame assembly back to the storage position from the working position, but while allowing the door frame assembly to remain at rest in the working position.

The connecting arm 106 comprises a threaded rod extending rearwardly of the pivot mount at the forward end. A rear end portion of the connecting arm is slidably received within a sleeve 108 formed on the front plate 104. A suitable nut 110 is threaded onto the connecting arm 106 at the location of a slot within the sleeve 108 to assist in positioning the connecting arm relative to the front plate 104 in a longitudinal direction of the connecting arm. Rotating the nut 110 acts to longitudinally displace the connecting arm relative to the front plate which in turn affects how much the springs are stretched in the working position, which in turn adjusts the amount of biasing force provided by the biasing arrangement of the hinge assembly.

The door frame assembly is mounted onto the hinge assemblies by mounting the two side rails 28 onto the two pivot arms 98 respectively using a pair of fasteners at longitudinally spaced positions along each pivot arm which fasten the pivot arm to the corresponding side rail 28. Each side rail has an exterior perimeter flange 112 which is perpendicular to the pivot axis and which spans substantially the full thickness of the door frame assembly and the full length between the foot end and the head end of the frame.

An inner support flange 114 protrudes laterally inwardly from one edge of the perimeter flange 112 corresponding to the bottom edge in the working position or the outermost edge in the stored position. Similarly, a top plate 116 protrudes inwardly from the opposing top or innermost edge of the perimeter flange 112 to be parallel and spaced apart from the inner support flange 114.

An inside plate 118 is mounted at right angles to the edge of the top plate 116 opposite from the perimeter flange 112 such that the inside plate 118 is parallel and spaced laterally inwardly relative to the perimeter flange 112. The inside plate 118 extends from the top plate 116 towards the inner support flange 114 of the side rail but terminates at a free edge which remains spaced from the inner support flange to define a channel between the free edge of the inside plate 118 and the inner support flange which is open laterally to the interior of the door frame assembly. In this manner opposing edges of the finishing panels mounted within the perimeter door frame are captured within the channels of the side rails at laterally opposing ends of each finishing panel. The channel is open at the foot end of the frame prior to mounting of the foot frame member such that the finishing panels of the door frame assembly and the intermediate supports 34 located between each adjacent pair of the finishing panels are all supported at laterally opposing ends within the channels of the two side rails 28 by longitudinally sliding the components along the side rails from the open ends at the foot end of the frame.

In the working position, the inner support flanges 114 provide support to the bottom face of the finishing panels at laterally opposing ends thereof so that the finishing panels can support weight of the mattress and occupants thereon without relying entirely on the holding strength of fasteners as occurs in typical prior art configurations.

Each side rail further includes a mounting plate 120 oriented perpendicularly to the longitudinal direction of the side rail at the head end to span across the channel. The mounting plate 120 at the head end of each side rail includes mounting apertures formed therein for alignment with corresponding mounting apertures in the opposing ends of the head frame member 30 to enable fastening of the head frame member onto the head ends of the side rails using suitable fasteners.

The head frame member 30 and the foot frame member 32 each have a common cross-sectional profile along the length thereof in the lateral direction so that the profiles are substantially identical to one another. That is, each of the head frame member and the foot frame member includes an exterior perimeter flange 122 which spans a full thickness of the perimeter door frame and the full width in the lateral direction oriented perpendicularly to the longitudinal direction of the side rails 28. An inner support flange 124 protrudes inwardly from the bottom edge of the perimeter flange 122 in the working position corresponding to the outermost edge of the perimeter flange in the storage position. The inner support flange 124 lies in a common plane with the inner support flange 114 of each side rail.

Each of the head frame member 30 and the foot frame member 32 further includes a top plate 126 which is parallel and spaced from the inner support flange 124 to protrude longitudinally inwardly of the door frame assembly from the edge of the perimeter flange 122 opposite to the inner support flange 124. An inside plate 128 extends from the top plate at a location that is parallel and spaced from the perimeter flange 122 towards the interior of the door frame assembly. The inside plate 128 supports an upper flange 130 at the edge of the inside plate 128 that is nearest to the inner support flange 124. The upper flange is parallel and spaced upwardly from the inner support flange 124 in the working position by a distance which is approximately equal to the thickness of the finishing panel. In this manner the corresponding edge of a first finishing panel at the head end of the frame can be received and captured between the inner support flange 124 and the upper flange 130 of the head frame member 30. Similarly, the corresponding edge of the last finishing panel at the foot end of the frame can be received and captured between the inner support flange 124 and the upper flange 130 of the foot frame member 32.

The head frame member 30 is further provided with faster apertures at opposing ends of the perimeter flange 122 for alignment with corresponding apertures in the mounting plates 120 at the head end of each side rail.

Figure 20:
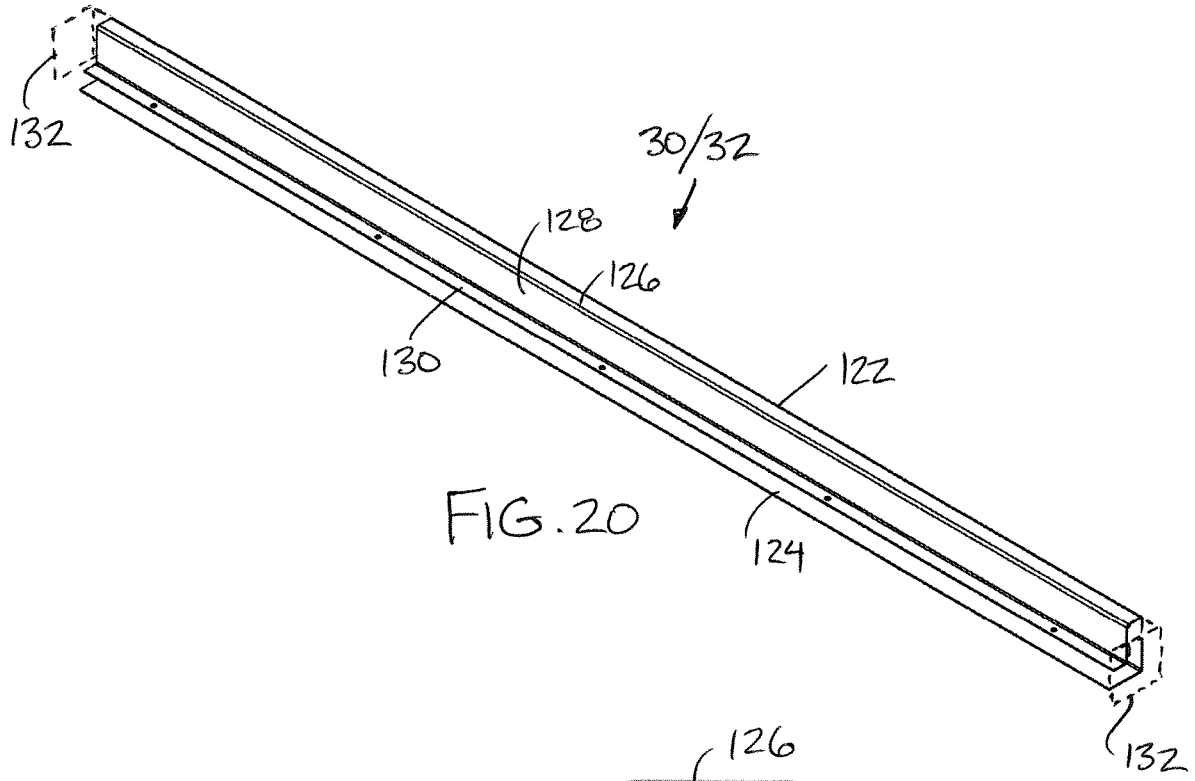
FIG. 20 is a perspective view of the head frame member of the door frame assembly, with the configuration of the foot frame member of the door frame assembly represented in broken line according to the first embodiment of FIG. 1.
Figure 21:
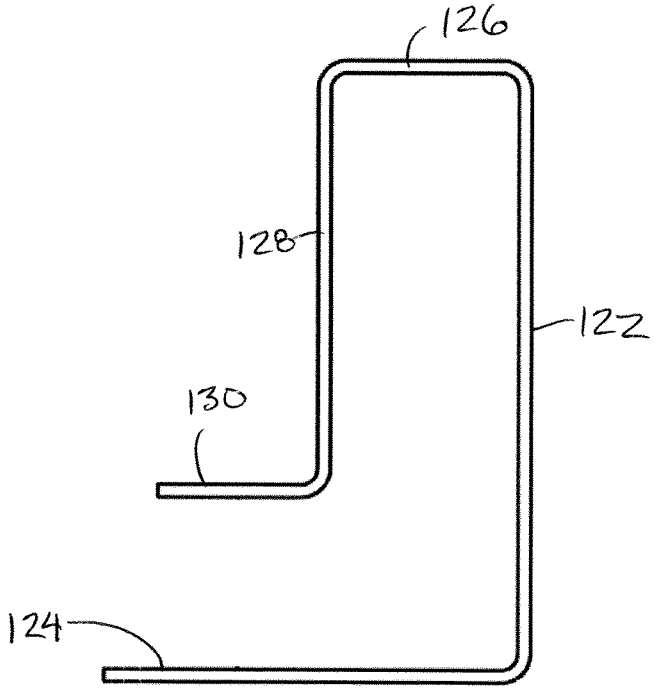
FIG. 21 is an end view of the head frame member of the door frame assembly according to the first embodiment of FIG. 1.
Figure 22:
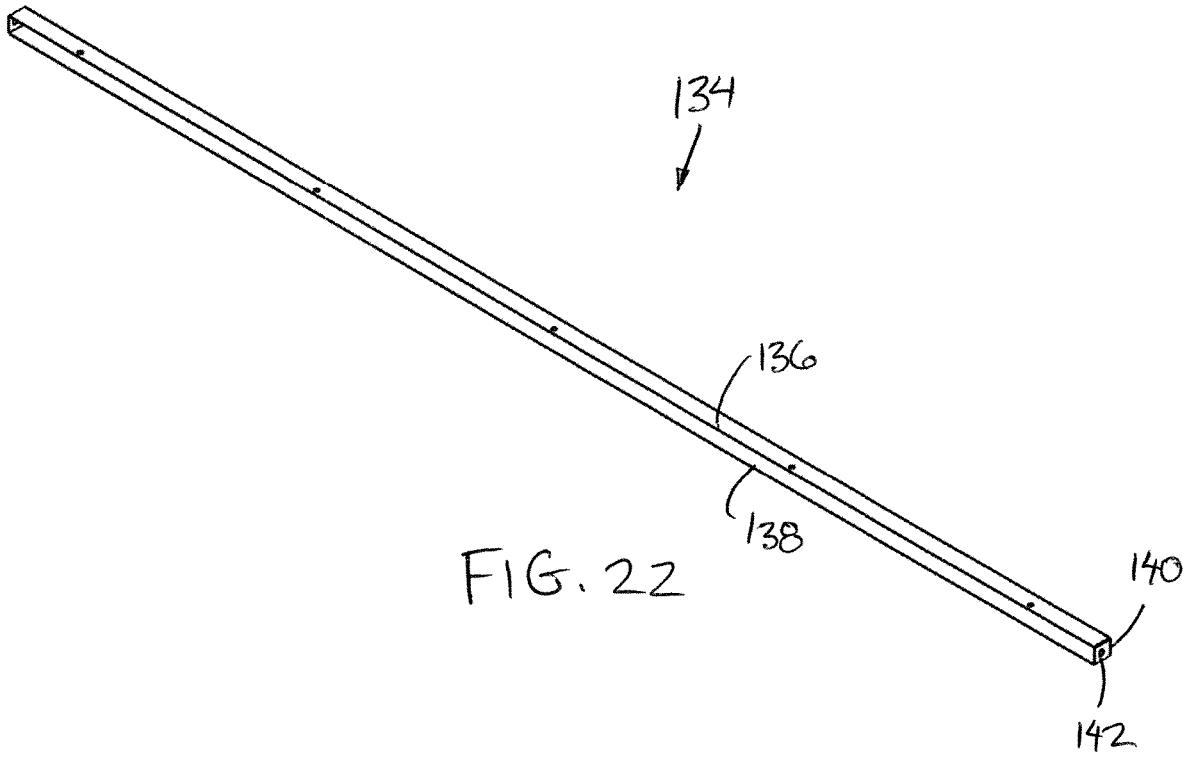
FIG. 22 is a perspective view of one of the channels forming the intermediate supports of the door frame assembly according to the first embodiment of FIG. 1.
Figure 23:
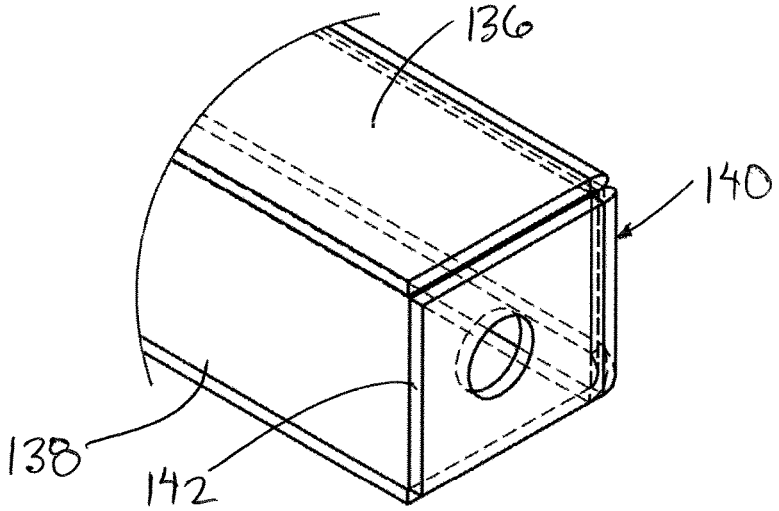
FIG. 23 is an enlarged view of one end of the channel forming one of the intermediate supports according to the first embodiment of FIG. 1.
Figure 24:
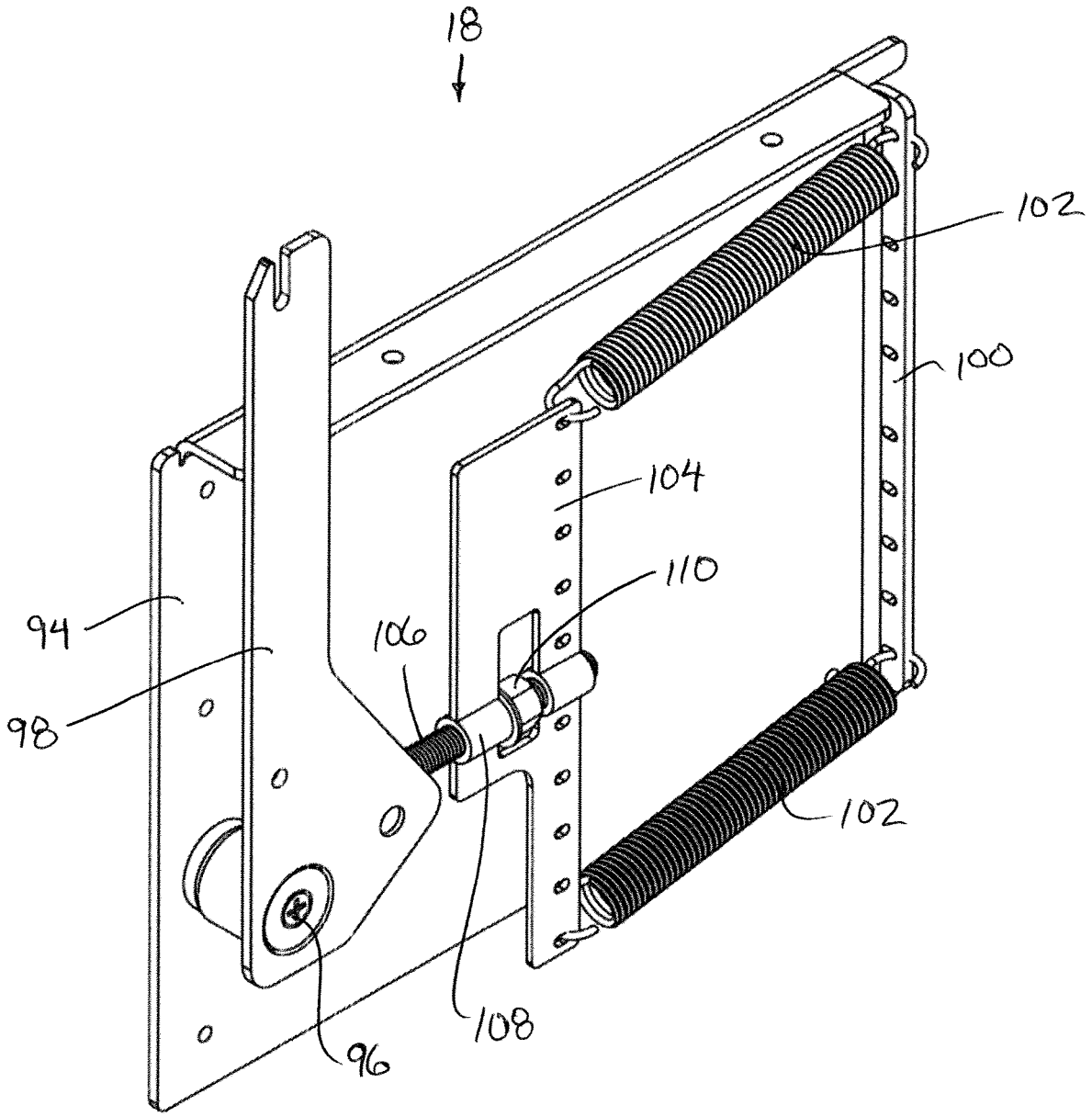
FIG. 24 is a perspective view of the hinge assembly with the cover shown removed according to the first embodiment of FIG. 1.
Figure 25:
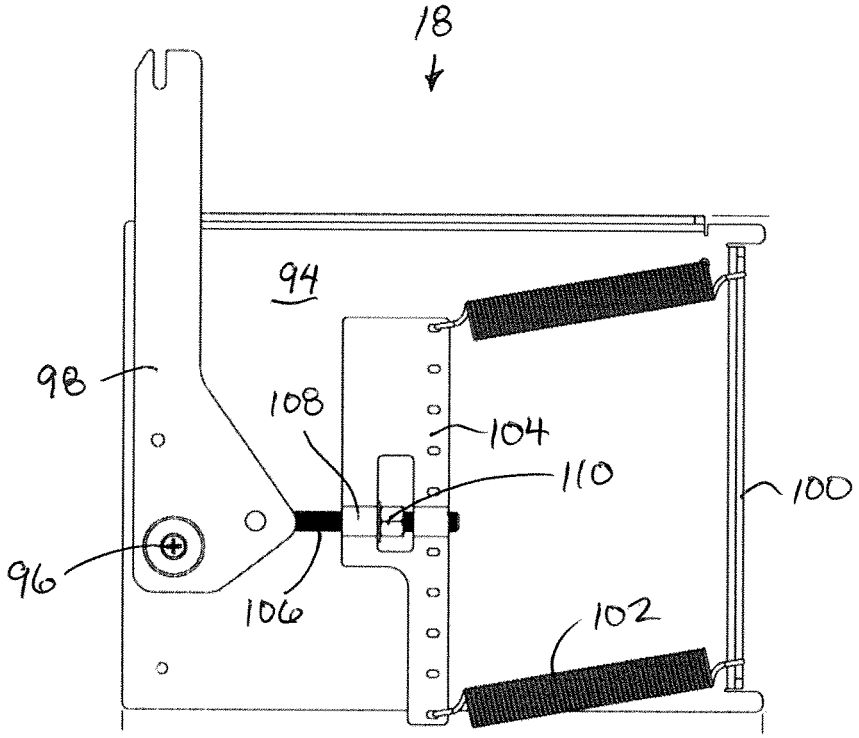
FIG. 25 is a side view of the hinge assembly in the storage position according to the first embodiment of FIG. 1.
Figure 26:
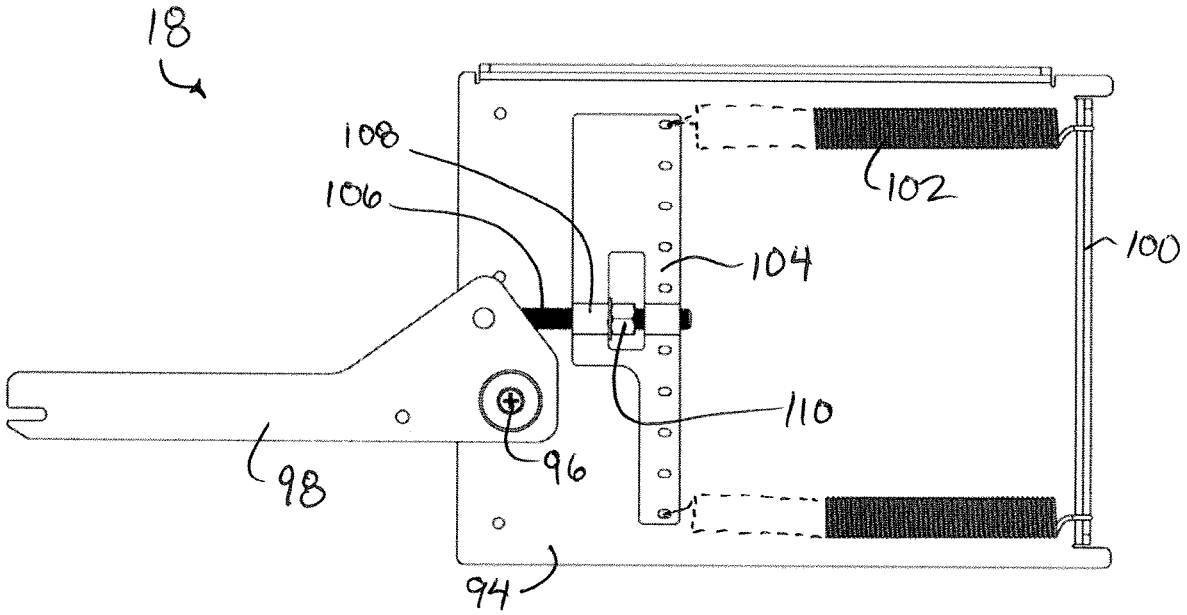
FIG. 26 is a side view of the hinge assembly in the working position according to the first embodiment of FIG. 1.
Figure 27:
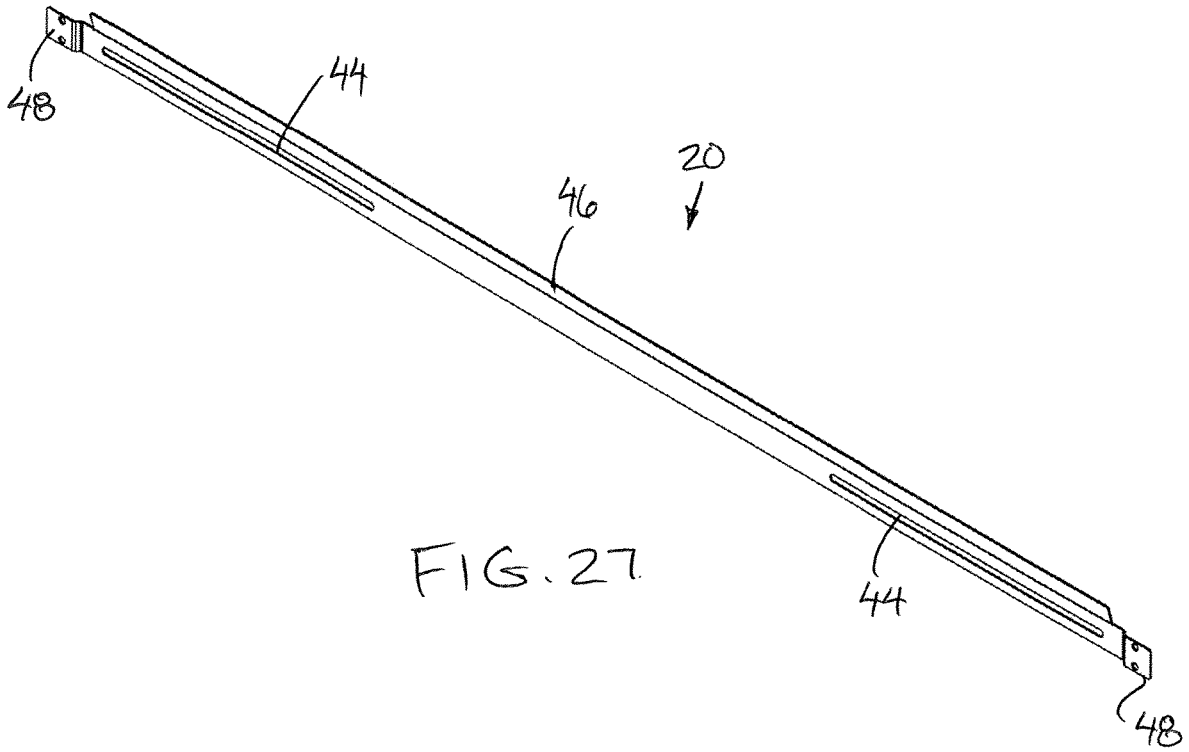
FIG. 27 is a perspective view of the header frame member for mounting on the wall according to the first embodiment of FIG. 1.
Figure 28:
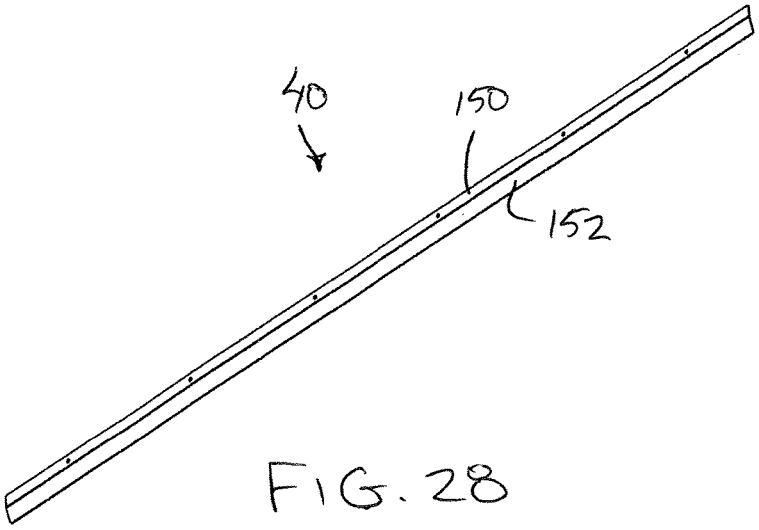
FIG. 28 is a perspective view of the headboard mounting member according to the first embodiment of FIG. 1.
Figure 29:
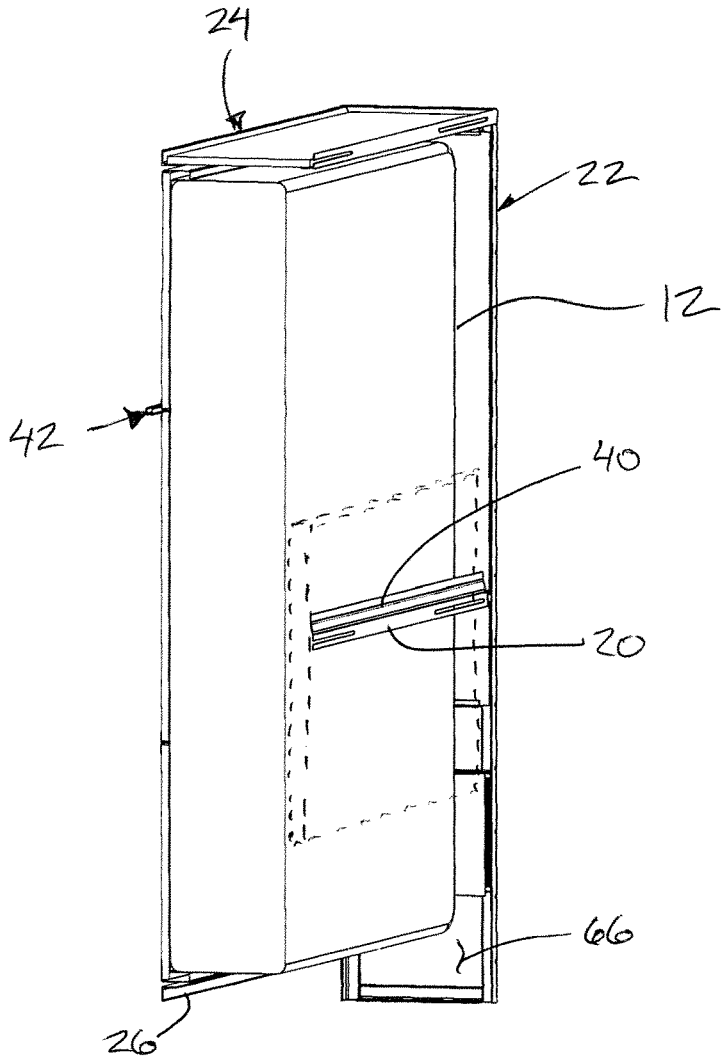
FIG. 29 is a partly sectional perspective view of the wall bed system according to the first embodiment of FIG. 1 illustrating a mattress supported therein and a headboard represented in broken line supported by the headboard mounting member on the header frame member mounted on the wall.
Figure 30:
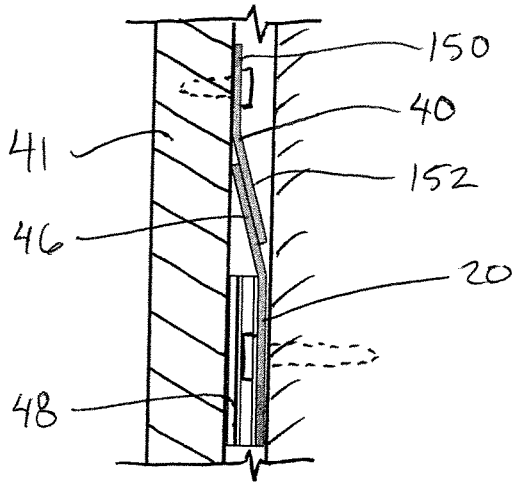
FIG. 30 is a sectional view of a headboard mounted by the headboard mounting member on the header frame member mounted on the wall according to the first embodiment of FIG. 1.

The foot frame member 32 is provided with mounting flanges 132, as shown in broken line in FIG. 20, which are perpendicular to the long axis of the foot frame member at the two opposing ends of the foot frame member respectively. The mounting flanges 132 are arrange to overlapped corresponding portions of the perimeter flanges 112 of the side rails 28 at the foot end thereof such that fastener apertures in the mounting flanges 132 and in the foot ends of the perimeter flanges 112 of the side rail 28 align with one another and receive suitable threaded fasteners to permit fastening of the foot frame member 32 between the two side rail 28 at the foot end of the door frame assembly.

Similarly to the inner support flanges 114 of each side rail, the inner support flanges 124 of the head frame member and the foot frame member overlap a bottom face of the corresponding finishing panels along the outermost edge of the finishing panel at the head end and the foot end of the door frame assembly respectively in the working position. Again, this provides a greater degree of support to enable the finishing panels to support weight of the mattress and occupants on the mattress without relying entirely on the strength of fasteners securing the finishing panels according to prior art configurations.

In the illustrated embodiment, three frame openings are provided in the door frame assembly which support three finishing panels therein respectively such that two intermediate supports 34 are provided, in which each intermediate support is provided between an adjacent pair of the finishing panels. Each intermediate support 34 is formed of two intermediate frame members 134 having a generally U-shaped profile which are mounted back-to-back to form an H shaped profile of the intermediate support 34. Each intermediate support 34 has a length which fits between the perimeter flanges 112 of the side rails so that opposing ends of the intermediate support 34 in the lateral direction are engaged upon the inner support flanges 114 similarly to the laterally opposing ends of the finishing panels.

Each U-channel 134 that forms part of the overall intermediate support 34 includes an upper flange 136 at the top side in the working position, a support flange 138 at the bottom side in the working position and a bridge 140 connected between the upper flange and the support flange to form the U-shaped profile. The bridges of two adjacent U-shaped profiles are mounted directly against one another to form the H shaped profile of the intermediate support 34. The upper flange 136 and the support flange 138 of each intermediate frame member 134 are parallel to one another and spaced apart by a distance corresponding approximately to the thickness of the finishing panels so that each channel receives a corresponding edge of a corresponding one of the finishing panels therein in the mounted position. The channels are positioned such that the open sides of the channel are oriented in the longitudinal direction of the door frame assembly to receive corresponding edges towards the foot end or the head end of each finishing panel that is not otherwise captured within the corresponding channel of either the head frame member 30 or the foot frame member 32.

A fastener flange 142 is mounted at each of the laterally opposing ends 140 of each channel of the intermediate support 34 so that the fastener flanges 142 are parallel and directly adjacent to corresponding ones of the exterior perimeter flanges 112 of the side rails 28 respectively in the mounted position. Fastener apertures in the fastener flanges 142 and in the perimeter flanges 112 of the side rails are aligned with one another in the mounted position to enable fasteners to fix the opposing ends of the intermediate supports 34 relative to the side rails 28.

According to the arrangement of the intermediate supports, the support flanges 138 of the intermediate supports 34 lie directly adjacent to a common plane with the inner support flanges of the side rails the head frame member 30 and the foot frame member 32 of the door frame assembly so that a set of support flanges are provided about the full perimeter of each finishing panel 38 mounted within a respective frame opening 36 in the door frame assembly. The support flanges are situated to overlap the bottom surface of the finishing panels in the working position, corresponding to the upright exterior face of the finishing panels in the storage position. In each instance, the perimeter edges of each finishing panel are fully concealed such that the finishing panel can be cut from any material having finished inner and outer faces without concern for any finishing being required on the cut perimeter edges. Furthermore, the arrangement of the support flanges about the full perimeter provides considerable support from below about the full perimeter of each finishing panel of the door frame assembly in the working position so that the finishing panels are well-suited for supporting large loads thereon in the working position.

The upper flanges 136 of the intermediate supports 34 as well as the upper flanges 130 of the head member 30 and the foot member 32 of the door frame assembly all lie in a common plane which overlaps an upper surface of the finishing panels in close proximity thereto in the working position so that the upper flanges 136 and 130 together with the upper surface of the finishing panels in the working position collectively define a substantially smooth and continuous supporting surface for the mattress across the full length of the door frame assembly between the head frame member 30 and the foot frame member 32 and across the full width of the door frame assembly between the two side rails 28.

The upper flanges 136 and 130 of the intermediate supports, the head member 30 in the foot member 32 respectively are also further provided with spaced apart fastener apertures along the length thereof which enable wood screws to be penetrated into the edge portions of the finishing panels which are overlapped by the upper flanges to further strengthen the load capacity of the finishing panels mounted within the door frame assembly.

The leg assembly 42 of the wall bed system is supported on two mounting flanges 144 which protrude forwardly from the side rails 28 of the door frame assembly in the storage position at a location nearer to the top end of the wall frame assembly than the bottom end thereof. The mounting flanges are parallel to one another and perpendicular to the pivot axis of the door frame assembly. Two legs 146 are pivotally coupled to interior sides of the two mounting flanges 144 respectively at respective first ends of the legs. The legs extend downwardly from the first ends to opposing second ends which are joined by a crossmember 148 of the leg assembly. The crossmember extends in the lateral direction between the two legs 146 at a location spaced below the pivotal coupling of the legs onto the mounting flanges 144. The leg assembly is freely suspended from the pivotal connection on the mounting flanges 144 so that the leg assembly is automatically and passively pivoted into a deployed configuration as the door frame assembly is lowered to a working position by the cross member 148 remaining suspended below the mounting flanges by force of gravity alone. The length of the legs 146 extending below the pivotal connection on the mounting flanges 144 corresponds approximately to the height of the pivot axis of the door frame assembly above the floor to support the door frame assembly in a horizontal orientation above the floor in the working position. The legs 146 and the crossmember 148 of the leg assembly 42 may be formed of any suitable rigid metal frame members. In preferred embodiments, the legs 146 comprises hollow tube material having an open bottom end enabling insertion of a non-marking plastic foot therein to prevent marking of the floor in a working position. The crossmember 148 may also be formed of a hollow tube material such that the crossmember 148 is configured to be comfortably gripped in handles the user pulling on the leg assembly to deploy the wall bed system from the storage position to the working position.

The headboard 41 (shown in FIG. 30) is supported on the header frame member 20 by the headboard mounting member 40. The headboard typically comprises a rectangular panel of finishing material which acts to conceal the header frame member in the mounted position. The headboard mounting member 40 includes a first flange 150 having a forward surface arrange for abutment against the rear side of the headboard and includes fastener apertures formed therein which receive fasteners for fastening the first flange 150 against the rear side of the headboard. A second flange 152 extends downwardly and rearwardly from a bottom edge of the first flange, for example at a downward and rearward slope of approximately 15 degrees, to a free bottom edge of the second flange such that the second flange defines a hook that is arranged to be received between the support flange 46 of the header frame member 20 and the building wall against which it is mounted. Once the headboard mounting member 40 is attached to the rear of the headboard, the headboard is merely hung on the wall by inserting the second flange 152 of the headboard mounting member 40 into the corresponding slot between the support flange 46 of the header frame member 20 and the building wall to hang the headboard on the wall with the header frame member 20 concealed by the headboard.

According to the wall bed system described herein, the system is initially installed on an upright wall of the building by first using a stud finder and hardware to locate studs within the wall and mark the locations of the studs. The header frame member 20 is then attached to the wall using a provided spacer to get an accurate mounting location on the wall. The side frames 20 that form gables at each side of the bed are then attached to opposing ends of the header frame member 20 using provided bolts which are mounted from the interior side of the side frames. The bottom rail or bottom frame member 26 is then connected between the two side frames using suitable fasteners accessible from the interior side of the side frames. Similarly, the top frame 24 is then attached across the top of the two side frames 22 using further threaded fasteners which are also attached from the interior of the wall frame assembly. All of the fasteners which assemble the side frames 22 to the remaining framing components of the wall frame assembly are mounted at locations spaced into the interior of the side frames with the fasteners being oriented parallel to a plane of the side frames. Once the wall frame assembly has been assembled, the top frame 24 is then secured to the wall using fasteners extending through the wall fastening apertures. This provides four contact points between the wall frame assembly and the wall, including two mounting locations at the top frame and two mounting locations at the intermediate location of the header frame member 20. The wood finishing panel 38 of the top frame can then be mounted in place to conceal any fasting locations of the top frame.

The door frame assembly is initially mounted by first mounting the hinge assemblies to the side frames including the pivot arms of the hinge assemblies. The adjustment nuts 110 are adjusted to position each of the pivot arms at a 30 degree angle from vertical. The side rails 28 of the door frame assembly are then attached to the pivot arms of the hinge assemblies respectively using a pair of longitudinally spaced apart bolts. The head frame member 30 is then attached across the head end of the side rails 28 using two bolts on each side. The first finishing panel closest to the head end of the finished door frame assembly is slid down the side rails through the open foot ends of the side rails until the finishing panel is seated into the channel of the head frame member while remaining captured at laterally opposing ends in the channels of the side rails. The first of two H-shaped intermediate supports 34 is then similarly inserted into the channels of the two side rails and placed over the exposed edge of the first finishing panel mounted on the door frame assembly. Once in position, the intermediate support 34 is fastened at laterally opposing ends at the fastening locations on the side rails using two bolts per side. The intermediate finishing panel is then similarly inserted through the open channels of the side rails at the foot end of the side rails and slid down the side rails until the leading edge is inserted into the channel of the previously installed intermediate support 34, followed by a similar installation of the second intermediate support 34 to capture the opposing edge of the intermediate finishing panel within the corresponding channel of the second intermediate support 34. The second intermediate support 34 is also secured to the side rails of the door frame assembly at opposing ends of the intermediate support 34. The last finishing panel of the foot end of the door frame assembly is then inserted down the channels of the side rails for insertion of the leading end into the remaining channel of the second intermediate support 34. The foot frame member 32 is then mounted across the foot end of the door frame assembly by ensuring that the remaining exposed edge of the last finishing panel is inserted into the corresponding channel of the foot frame member 32 as the foot frame member is installed. The foot frame member is secured with two bolts on either side at the foot end of the side rails.

The wood screws can then be inserted into the through holes in the upper flanges of the channels on the intermediate supports 34 and the head frame member 30 and the foot frame member 32. The finishing panels 38 of the door frame assembly are thus firmly attached to the rigid frame members of the door frame assembly.

The adjustment nuts 110 of the hinge assemblies can be further adjusted to return the hinge assembly pivot arms to a vertical orientation. Fine-tuning of the position of the nuts along the threaded connecting arms is required based on the size and weight of the mattress. The hinge mechanism can be adjusted by accessing the mechanism through the open frame openings 36 in the side frames regardless of the position of the door frame assembly. When all adjustments are complete, the finishing panels 38 for the frame openings in the side frames can be mounted in place within the side frames. Furthermore, the headboard can be mounted in place by hooking the headboard mounting member 40 onto the header frame member 20 as described above as a final assembly step.

In some instances, the finishing panel in the top frame can be left removed where it is desirable for the wall bed system to remain protected from fire by an overhead sprinkler for example.

Turning now to FIGS. 31 to 35, a second embodiment of the wall bed system 10 will now be described in further detail. The wall bed system 10 in this instance is substantially identical to the previous embodiment with the exception of the following described features.

The wall bed system 10 according to FIGS. 31 to 35 is partly distinguished from the previous embodiment in that all of the rigid metal frame members forming the side frames 22, the top frame 24, and the header frame member 20 of the wall frame assembly 14 and the various frame members of the door frame assembly 16 are manufactured by laser cutting sheet metal followed by various folding steps and some welding in order to assemble the frames. Some of the most noticeable changes appear in the side frames 22 in which the flanges surrounding the frame opening 36 that receives a finishing panel 38 therein (previously the inner flanges 58) are instead formed as a continuous sheet together with the enclosed bottom portion (previously occupied by the rigid sheet 66). The perimeter flanges 56 are also formed as a continuous sheet with the inner flanges 58 and the enclosed bottom sheet 66, but the perimeter flanges 56 are folded and subsequently welded together at the corners to form the side frame structure shown in FIG. 32.

An additional top bracket 200 is welded beneath the underside of the perimeter flange 56 at the top of the side frame in proximity to the upper boundary of the central frame opening 36, and an additional bottom bracket 202 is welded to the inner side of the enclosed lower sheet 66 in proximity to the lower boundary of the central frame opening 36 to provide support for the finishing panel 38 secured against the inner surfaces of the inner flanges 58 about the perimeter of the frame opening 36.

The top bracket 200 includes a first flange 204 that is welded flat against the underside of the uppermost perimeter flange 56 of the side frame and a second flange 206 extending downward from the inner side of the first flange 204 to replace the inner plate 68 that formed part of an upper channel receiving the uppermost edge of the finishing panel 38 inserted therein in the assembled configuration. The bottom bracket 202 similarly comprises first and second flanges mounted perpendicularly to one another similarly to the inner plate 70 of the previous embodiment to define a lower channel that receives the lowermost edge of the finishing panel 38 inserted therein in the assembled configuration.

The second flange 206 of both the top and bottom brackets includes threaded apertures formed therein through which set screws 208 can be received such that the set screws are aligned with the innermost surface of the finishing panel 38 received within upper channel of the top bracket and the lower channel of the bottom bracket. Tightening the screws 208 thus applies an outward pressure to firmly press the finishing panel 38 against the inner surfaces of the flanges 58 extending about the perimeter of the frame opening 36.

The top bracket 200 of each side frame also provides support for a door stop member 210 using a door stop mounting flange 212 extending horizontally inward from the bottom edge of the second flange 206 adjacent the forward end thereof. The door stop member 210 is supported on a threaded shaft received within a corresponding threaded sleeve secured to the underside of the door stop mounting flange 212 such that rotating the threaded shaft causes the door stop member 210 to be adjusted in depth relative to the opening at the front of the wall frame assembly 14 that receives the door frame assembly therein in the storage position. The door stop member 210 is typically supported by the top bracket to be located (i) in proximity to the top frame for engaging the foot frame member 32 of the door frame, and/or (ii) adjacent the inner side of the respective side frame for engaging the side rail 28 of the door frame in the storage position. The depth of the door stop members 210 are typically adjusted such that when the door frame assembly engages the door stop members on both side frames, the exterior side of the door frame assembly is substantially flush with the front edges of the side frames 22 respectively.

Each side frame 22 according to the second embodiment is also provided with an additional clamp plate 211 arranged to be clamped against the inner surface of the finishing panel 38 at both the forward and rearward edges at an intermediate location along the height of the panel between the top and bottom edges thereof. Each clamp plate 211 is clamped against the inner surface of the finishing panel by a bolt 213 that is fastened through the clamp plate and into a threaded socket 209 that is fixed to the side frame at a location offset to one side of the frame opening. In the illustrated embodiment, the threaded socket 209 is formed within a nut that is welded to the inner surface of one of the inner flanges 58 at the side of the frame opening 36 in close proximity to the perimeter flange 56. Tightening the bolt 213 threaded into the socket 209 acts to clamp the clamp plate 211 against the inner surface of the finishing panel 38 which also urges the finishing panel tightly against the inner surfaces of the inner flanges 58 about the perimeter of the frame opening 36, and is useful to prevent the finishing panel bowing inwardly at an intermediate location between the top and bottom ends of the panel.

Figure 31:
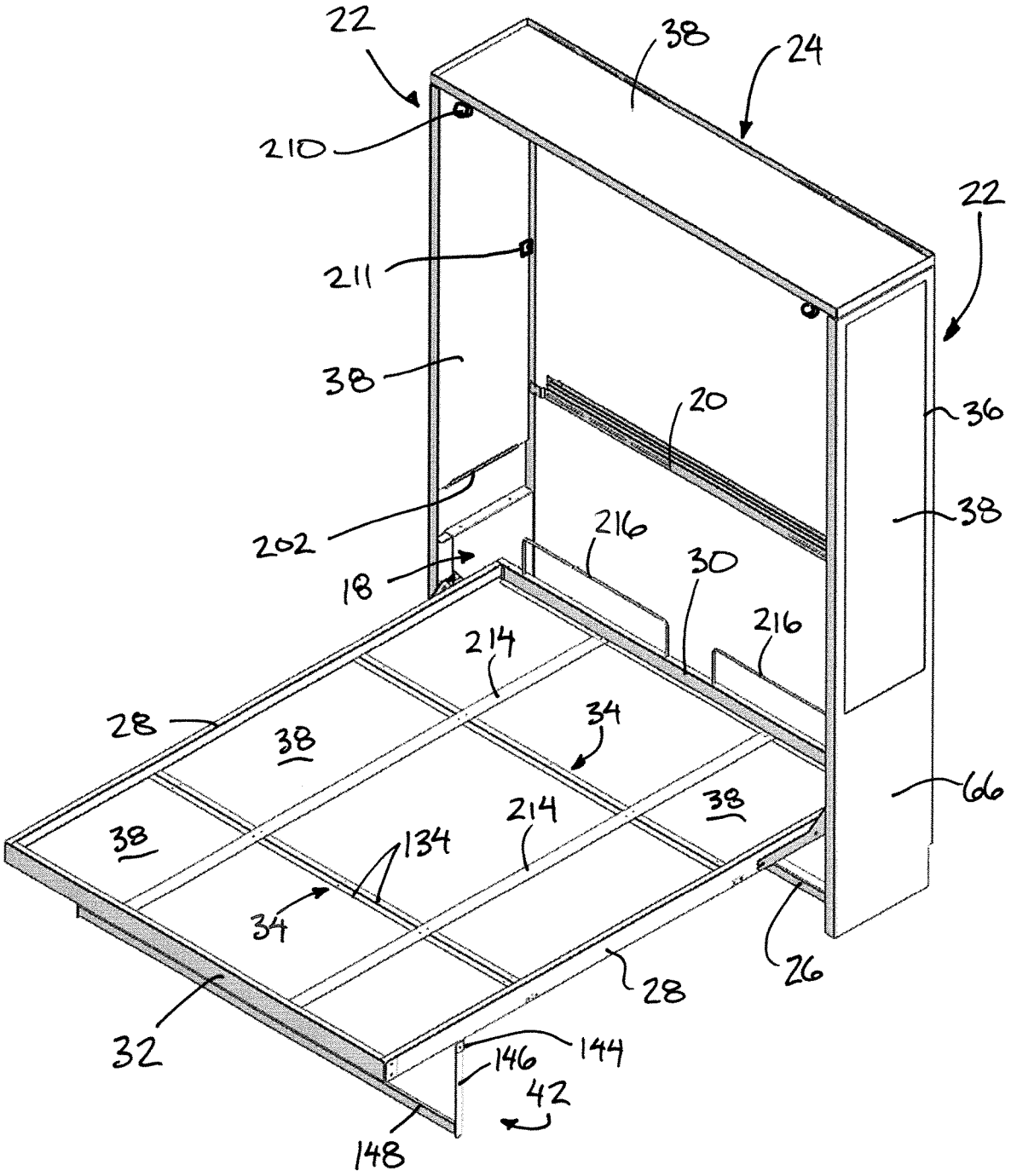
FIG. 31 is a perspective view of the wall bed system according to a second embodiment.
Figure 32:
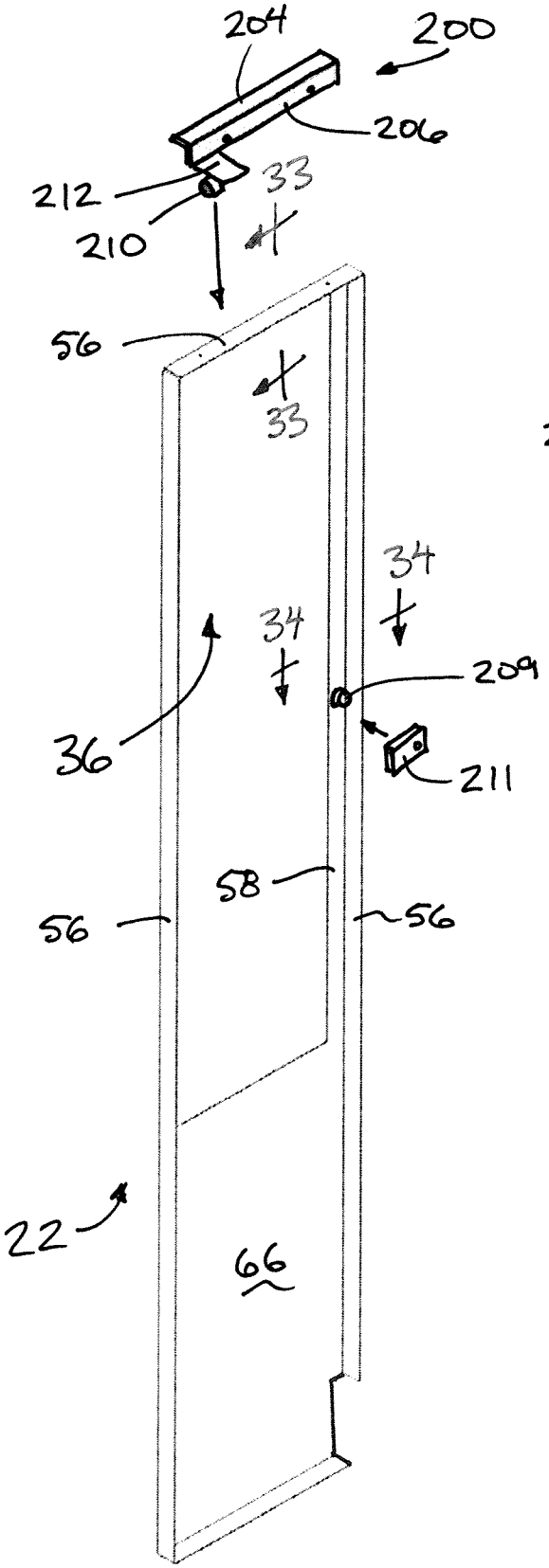
FIG. 32 is a perspective view of an inner side of one of the side frames of the wall bed system according to the second embodiment of FIG. 31.
Figure 33:
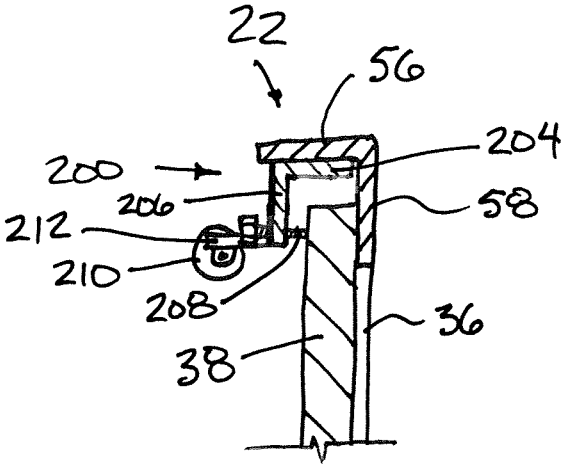
FIG. 33 is a sectional view along the line 33-33 in FIG. 32.
Figure 34:
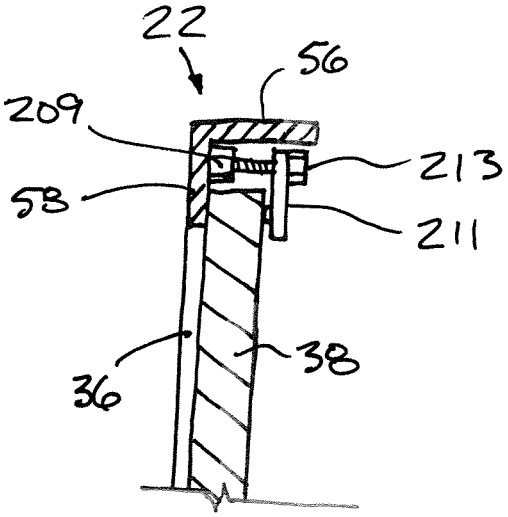
FIG. 34 is a sectional view along the line 34-34 in FIG. 32.

As shown in FIG. 31, the door frame assembly 16 is distinguished from the previous embodiment by the addition of two longitudinal support members 214. The longitudinal support members 214 extend the full length of the door frame assembly between the head frame member 30 and the foot frame member 32 so as to be parallel to the side rails 28 at intermediate locations spaced apart from one another and spaced laterally inwardly from the side rails 28 respectively. Each longitudinal support member 214 is a flat bar of rigid metal that lies flat against the upper flanges 136 of the intermediate frame members 134 and flat against the top of the upper flanges 130 of the head frame member 30 and the foot frame member 32. Pre-formed fastener apertures in the longitudinal support members are aligned with corresponding pre-formed fastener apertures formed in the upper flanges 136 and 130 across which the longitudinal support members lie. Accordingly, screws can be inserted through the overlapping fastener apertures and penetrated into the material of the finishing panels 38 of the door frame assembly to secure the various components of the door frame assembly rigidly relative to one another. The addition of the longitudinal support members 214 accurately aligns the intermediate frame members 134 with the head frame member 30 and the foot frame member 32 to assist in squaring the door frame assembly during assembly.

The door frame assembly may also be distinguished from the previous embodiment in that the pair of U-shaped intermediate frame members 134 that are joined together to form each intermediate support 34, can be securely welded together to form a singular H-shaped frame member that is assembled into the door frame assembly between adjacent finishing panels 38 as a single unitary body to also contribute to the structural rigidity of the door frame assembly.

As shown in FIG. 31, the door frame assembly is also provided with additional mattress support members 216 which are welded in fixed relation to the head frame member 32 protrude upwardly from the top side thereof in the working position of the door frame assembly. In the second illustrated embodiment, two mattress support members 216 are laterally spaced apart from one another on the head frame member 30. Each mattress support member 216 is a rigid metal bar formed in a U-shape in which the opposing ends of the bar are fixed onto the head frame member 30 such that the pair of mattress support members 216 lie in a common plane that is perpendicular to the longitudinal direction of the door frame assembly for abutment against the head end of the mattress 12 supported on the door frame assembly. The mattress support members 216 thus provide support to the mattress to maintain the mattress properly aligned with the door frame assembly when the door frame assembly is pivoted into the vertical orientation of the storage position.

Figure 35:
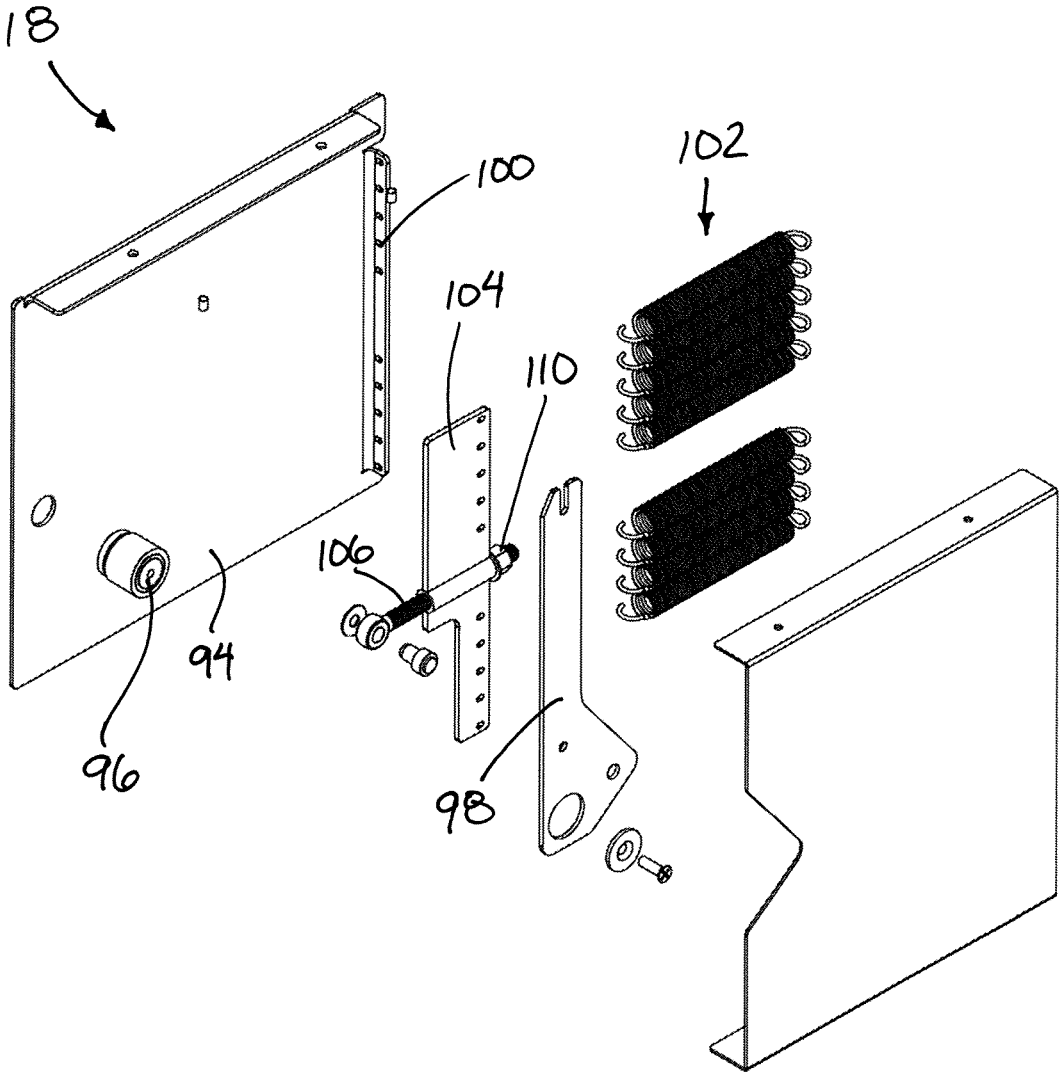
FIG. 35 is an exploded perspective view of the hinge assembly of the wall bed system according to the second embodiment of FIG. 31.

The wall bed system 10 according to the second embodiment is further distinguished from the previous embodiment by the configuration of the front plate 104 of each hinge assembly 18 as shown in FIG. 35. In this instance, the sleeve 108 supported on the plate 104 spans the full depth of the front plate between opposing front and rear edges of the plate. The connecting arm 106 is suitably sized to pass through the full depth of the sleeve 108 and protrude from the rear edge of the plate 104 by a sufficient distance to receive the nut 110 threaded onto the connecting arm 106. In this instance, the nut 110 is positioned rearwardly of the rear edge of the plate 104 for engaging the rear edge of the plate in operation. In this manner, access to the nut 110 at the rear of the plate 104 is open and unobstructed to enable use of a ratchet tool for engaging the nut 110 to vary the tension applied by the springs 102 to the hinge assembly 18 as described above in regards to the previous embodiment.

Despite some differences in the manufacturing of some of the frame components in the second embodiment of FIGS. 31 through 35, the resulting manufactured frames are mounted onto the upright building wall and assembled relative to one another in substantially the same manner as the previous embodiment with some notable exceptions such as the intermediate frame members 134 forming each intermediate support 34 being mounted together onto the side rails 28 instead of sequentially according to the previous embodiment. Some additional assembly steps are also included in the second embodiment such as tightening of the set screws 208 and the tightening of the intermediate clamp plates against the finishing panels 38 subsequent to installation of the finishing panels within the frame openings 36 of the side frames 22.

Since various modifications can be made in the invention as herein above described, and many apparently widely different embodiments of same made, it is intended that all matter contained in the accompanying specification shall be interpreted as illustrative only and not in a limiting sense.

The invention claimed is:

1. A wall bed system for mounting against an upright wall of a building, the system comprising:

a wall frame assembly arranged to be secured to the upright wall; and a door frame assembly arranged to support a mattress thereon, the door frame assembly being arranged to be pivotally coupled to the wall frame assembly for movement between a storage position in which the door frame assembly supports the mattress to be fully enclosed in an upright orientation within the wall frame assembly and a working position in which the door frame assembly supports the mattress in a horizontal orientation for sleeping;

the wall frame assembly comprising: (i) a header frame member arranged to be fastened onto the upright wall, (ii) two side frames arranged to be mounted onto opposing ends of the header frame member respectively at opposing sides of the wall frame assembly, in which the side frames substantially span a depth of the wall frame assembly protruding from the upright wall and substantially span a height of the wall frame assembly, and (iii) a top frame arranged to be mounted between the two side frames at a top of the wall frame assembly, in which the top frame substantially spans a width of the wall frame assembly between the side frames;

the door frame assembly comprising a perimeter frame spanning a width and a length of the door frame assembly;

at least one of the top frame of the wall frame assembly, the side frames of the wall frame assembly, and the perimeter frame of the door frame assembly comprising a modular frame;

the modular frame comprising a plurality of rigid frame members surrounding one or more frame openings of the modular frame such that said at least one frame opening is bounded by the rigid frame members and a finishing panel of finishing material arranged to be fully received within the one or more frame openings so as to be releasably mounted relative to the modular frame;

wherein the finishing panel of the modular frame is readily removable while the rigid frame members of the modular frame remain in an assembled configuration relative to the wall frame assembly and the door frame assembly; and wherein the side frames of the wall assembly each comprise said modular frame, each side frame further including an upper channel defining an upper slot receiving a top edge of the finishing panel and a lower channel defining a lower slot receiving a lower edge of the finishing panel in a mounted position of the finishing panel, a height of the finishing panel being less than a vertical distance between an upper terminal end of the upper slot and an upper edge defining a mouth of the lower slot to enable the finishing panel to be separated from the side frame by lifting until a bottom end of the finishing panel clears the lower slot.

2. The system according to claim 1 wherein perimeter edges of the finishing panel are concealed by the modular frame in a mounted position of the finishing panel on the modular frame.

3. The system according to claim 1 further comprising:

a hinge assembly on each side of the wall frame assembly arranged to pivotally couple the wall frame assembly to a corresponding side of the wall frame assembly, the hinge assembly including a biasing arrangement arranged to apply a biasing force acting to assist in closing the door frame assembly towards the storage position;

the side frames of the wall frame assembly each comprising said modular frame having (i) said plurality of rigid frame members surrounding the frame opening of the side frame and (ii) said finishing panel arranged to be received within the frame opening;

the frame opening of each side frame spanning a majority of a height of the side frame at a location above the corresponding hinge assembly whereby adjustment of the hinge assembly is accessible through the corresponding frame opening in a closed position of the door frame assembly when the finishing panel is removed from the side frame.

4. The system according to claim 1 wherein each side frame comprises:

a hinge assembly arranged to pivotally couple one side of the wall frame assembly to a corresponding side of the door frame assembly, the hinge assembly including a biasing arrangement arranged to apply a biasing force acting to assist in closing the door frame assembly towards the storage position;

a plurality of rigid frame members extending about a perimeter of the side frame; and a rigid sheet metal panel arranged to span a lower portion of the side frame in alignment with the hinge assembly;

the rigid sheet metal panel being supported at an exterior side of the side frame so as to define a cavity between the rigid frame members about the perimeter of the side frame, the cavity being open to an interior of the wall frame assembly, and the cavity receiving a portion of the hinge assembly recessed therein in a lateral direction of the wall frame assembly.

5. The system according to claim 1 further comprising:

the top frame of the wall frame assembly comprising said modular frame having (i) said plurality of rigid frame members surrounding the frame opening of the top frame and (ii) said finishing panel arranged to be received within the frame opening;

the top frame further comprising a plurality of support flanges mounted on the rigid frame members to protrude into the frame opening so as to be arranged to support said finishing panel thereon at an elevational below a top of the rigid frame members such that the finishing panel is recessed below the top of the rigid frame members.

6. The system according to claim 5 further comprising wall fasteners apertures located in one of the rigid frame members of the top frame at a rear of the wall frame assembly arranged to receive fasteners for fastening the wall frame assembly to the upright wall of the building, the wall fastener apertures being concealed by said finishing panel in a mounted position of the finishing panel on the top frame.

7. The system according to claim 5 further comprising frame fastener apertures in the rigid frame members arranged to receive fasteners for fasting the top frame to each side frame of the wall frame assembly, the frame fastener apertures being concealed by said finishing panel in a mounted position of the finishing panel on the top frame.

8. The system according to claim 1 wherein the header frame member comprises:

an elongate rigid member having a rear surface arranged for abutment against said upright wall;

wall fastener apertures at laterally spaced apart positions along the rigid member so as to be arranged to receive fasteners to fasten the header frame member against said upright wall; and frame mounts at opposing ends of the header frame member arranged for fixed mounting to the two side frames respectively;

the frame mounts being spaced forwardly of said rear surface whereby the frame mounts are arranged for connection to the side frames subsequent to mounting of the header frame member onto the upright wall of the building.

9. The system according to claim 8 wherein each frame mount comprises (i) a mounting flange oriented parallel to the rear surface at a location spaced forwardly of the rear surface and (ii) at least one frame fastener aperture in the mounting flange arranged to receive a fastener to fasten the mounting flange to the respective side frame.

10. A wall bed system for mounting against an upright wall of a building, the system comprising:

a wall frame assembly arranged to be secured to the upright wall;

a door frame assembly arranged to support a mattress thereon, the door frame assembly being arranged to be pivotally coupled to the wall frame assembly for movement between a storage position in which the door frame assembly supports the mattress to be fully enclosed in an upright orientation within the wall frame assembly and a working position in which the door frame assembly supports the mattress in a horizontal orientation for sleeping;

the wall frame assembly comprising: (i) a header frame member arranged to be fastened onto the upright wall, (ii) two side frames arranged to be mounted onto opposing ends of the header frame member respectively at opposing sides of the wall frame assembly, in which the side frames substantially span a depth of the wall frame assembly protruding from the upright wall and substantially span a height of the wall frame assembly, and (iii) a top frame arranged to be mounted between the two side frames at a top of the wall frame assembly, in which the top frame substantially spans a width of the wall frame assembly between the side frames;

the door frame assembly comprising a perimeter frame spanning a width and a length of the door frame assembly;

at least one of the top frame of the wall frame assembly, the side frames of the wall frame assembly, and the perimeter frame of the door frame assembly comprising a modular frame;

the modular frame comprising a plurality of rigid frame members surrounding one or more frame openings of the modular frame and a finishing panel of finishing material arranged to be received within the one or more frame openings so as to be releasably mounted relative to the modular frame; and the header frame member comprising: (i) an elongate rigid member having a rear surface arranged for abutment against said upright wall, (ii) wall fastener apertures at laterally spaced apart positions along the rigid member so as to be arranged to receive fasteners to fasten the header frame member against said upright wall, and (iii) a support flange extending upwardly from the elongate rigid member to an upper free edge spaced forwardly of said rear surface; and a headboard mounting member comprising: (i) a first flange having a forward surface arranged for abutment against a rear side of a headboard and fasteners apertures so as to be arranged for fastening the first flange to the rear side of the headboard, and (ii) a second flange extending downwardly and rearwardly from the first flange to a free edge of the second flange in a mounted position of the headboard such that the second flange defines a hook arranged to be received between the support flange of the header frame member and said upright wall in the mounted position of the headboard.

11. The system according to claim 1 wherein each side frame is arranged to be fastened to the top frame and the header frame member at a location spaced laterally inward from an exterior side surface of the side frame farthest from the other side frame.

12. The system according to claim 11 wherein each side frame is arranged to be fastened to the top frame and the header frame member using fasteners oriented parallel to a plane of the exterior side surface of the side frame.

13. The system according to claim 1 wherein the perimeter frame of the door frame assembly includes (i) said at least one frame opening surrounded by said rigid frame members of the perimeter frame and (ii) said finishing panel supported within said at least one frame opening by support flanges mounted on the rigid frame members and extending about a full perimeter of said at least one frame opening.

14. The system according to claim 13 wherein said at least one frame opening of the door frame assembly comprises a plurality of frame openings and wherein the rigid frame members of the perimeter frame of the door frame assembly comprise:

two side rails spanning a length of the door frame assembly at laterally opposing sides of the door frame assembly respectively, each side rail including an inner flange protruding inwardly towards the other side rail defining the support flanges that support laterally opposing sides of each finishing panel thereon;

a head frame member connected between the two side rails at a head end of the door frame assembly;

a foot frame member connected between the two side rails at a foot end of the door frame assembly; and an intermediate support mounted between each adjacent pair of the finishing panels, the intermediate support being supported on the inner flanges of the side rails at opposing ends thereof;

some of the support flanges being supported on the head frame member, on the foot frame member and on the intermediate support so as to be arranged to support opposing ends of the finishing panels thereon.

15. The system according to claim 13 further comprising:

said rigid frame members of the perimeter frame further comprising upper flanges mounted on the rigid frame members along a portion of said at least one frame opening at a location spaced from the support flanges by a thickness of said at least one finishing panel such that corresponding edges of said at least one finishing panel are captured between one of the support flanges and one of the upper flanges about said portion of said at least one frame opening;

the upper flanges and an inner surface of said at least one finishing panel collectively defining a continuous supporting surface arranged to support the mattress thereon.

16. A method of assembling a wall bed against an upright wall of a building, the method comprising:

providing a wall bed system comprising:

(i) a wall frame assembly arranged to be secured to the upright wall; and (ii) a door frame assembly arranged to support a mattress thereon, the door frame assembly being arranged to be pivotally coupled to the wall frame assembly for movement between a storage position in which the door frame assembly supports the mattress to be fully enclosed in an upright orientation within the wall frame assembly and a working position in which the door frame assembly supports the mattress in a horizontal orientation for sleeping;

(iii) the wall frame assembly comprising: (a) a header frame member, (b) two side frames arranged to substantially span a depth of the wall frame assembly protruding from the upright wall and substantially span a height of the wall frame assembly, and (c) a top frame arranged to substantially spans a width of the wall frame assembly between the side frames;

(iv) the door frame assembly comprising a perimeter frame spanning a width and a length of the door frame assembly;

(v) wherein the door frame assembly comprises plurality of rigid frame members surrounding a plurality of frame openings in the perimeter frame and a finishing panel mounted within each frame opening, the rigid frame members of the door frame assembly including (a) two side rails for spanning a length of the door frame assembly at laterally opposing sides of the door frame assembly respectively, (b) a head frame member for connection between the two side rails at a head end of the door frame assembly, (c) a foot frame member for connection between the two side rails at a foot end of the door frame assembly, and (d) an intermediate support for mounting between each adjacent pair of the finishing panels, mounting the header frame member on the upright wall;

mounting the side frames on opposing ends of the header frame member subsequent to the header frame member being mounted on the upright wall;

mounting the top frame between the side frames at a top of the wall frame assembly;

mounting the perimeter frame of the door frame assembly on the side frames of the wall frame assembly so as to be pivotal between the working position and the storage position;

wherein the mounting of the perimeter frame of the door frame assembly on the side frames of the wall frame assembly further comprises:

pivotally coupling the side rails of the door frame assembly onto the side frames of the wall frame assembly and mounting the head frame member between the two side rails at the head end of the door frame assembly;

mounting a first panel among the finishing panels between the side rails at the head end of the door frame assembly;

mounting the intermediate support against an inner end of the first panel subsequent to the first panel being mounted between the side rails and prior to a second panel among the finishing panels being installed between the side rails; and subsequent to all finishing panels being mounted between the side rails, mounting the foot frame member between the side rails at the foot end of the door frame assembly.

17. The method according to claim 16 wherein at least one of the top frame or the side frames comprises a modular frame comprised of rigid frame members surrounding at least one frame openings in the modular frame, and wherein the method further comprises mounting a finishing panel within said at least one finishing panel subsequent to the modular frame being mounted in fixed relation to the upright wall of the building.

* * * * *